US011905668B1

(12) United States Patent
Whitaker

(10) Patent No.: US 11,905,668 B1
(45) Date of Patent: Feb. 20, 2024

(54) RPM INSTALLER

(71) Applicant: Dustin Whitaker, Childress, TX (US)

(72) Inventor: Dustin Whitaker, Childress, TX (US)

(73) Assignee: EcoPath Striping LLC, Tyler, TX (US)

( * ) Notice: Subject to any disclaimer, the term of this patent is extended or adjusted under 35 U.S.C. 154(b) by 0 days.

(21) Appl. No.: 18/363,544

(22) Filed: Aug. 1, 2023

(51) Int. Cl.
*E01C 23/00* (2006.01)
*E01C 23/18* (2006.01)

(52) U.S. Cl.
CPC ..... *E01C 23/18* (2013.01)

(58) Field of Classification Search
CPC ..... E01C 23/18
USPC ..... 404/75, 93, 94, 111
See application file for complete search history.

(56) References Cited

U.S. PATENT DOCUMENTS 3,179,289 A * 4/1965 Moyer ..... G07F 11/54 221/121
3,590,701 A * 7/1971 Ten Broeck ..... E01C 23/18 404/94
4,936,485 A * 6/1990 Downing ..... E01C 23/18 404/93
4,974,990 A * 12/1990 Anderson ..... E01C 23/18 404/94
5,853,263 A * 12/1998 Green ..... E01C 23/18 404/94
5,934,822 A * 8/1999 Green ..... E01C 23/18 404/94
10,626,565 B2 * 4/2020 Webb ..... E01F 9/512
11,203,844 B2 * 12/2021 Bjorklund ..... E01C 23/18
2013/0105078 A1 * 5/2013 Dawson ..... E01C 23/082 404/93
2017/0100737 A1 * 4/2017 Howseman, Jr. ..... F16K 49/002

FOREIGN PATENT DOCUMENTS

DE 3526711 A1 * 7/1985 ..... E01C 23/16

OTHER PUBLICATIONS

Automated Roadway Pavement Marker Placement System https://youtu.be/lgMFgeEjKYk (screen shots provided as a PDF along with this filing), Feb. 25, 2013.

* cited by examiner

*Primary Examiner* — Raymond W Addie
(74) *Attorney, Agent, or Firm* — Shannon Warren

(57) ABSTRACT

An RPM installer for automatically aligning an RPM dispenser assembly and an adhesive dispenser over a marker location on a roadway and installing an RPM marker at the marker location. The RPM installer comprises a mounting assembly, a sliding assembly, the RPM dispenser assembly and the adhesive dispenser. The mounting assembly is configured to attach to a vehicle. The RPM installer comprises a forward movement direction aligned with a forward moving direction of the vehicle. The RPM installer comprises a front side associated with the forward movement direction, a rear side, an interior side adjacent with the vehicle, and an exterior side. The sliding assembly is configured attach to and selectively slide relative to the mounting assembly in directions substantially aligned with the forward movement direction. The RPM dispenser assembly and the adhesive dispenser are mounted to a portion of the sliding assembly.

20 Claims, 23 Drawing Sheets

RPM INSTALLER

CROSS-REFERENCE TO RELATED APPLICATIONS

Not applicable.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

An RPM installer for automatically aligning an RPM dispenser assembly and an adhesive dispenser over a marker location on a roadway and installing an RPM marker at said marker location. said RPM installer comprises a mounting assembly, a sliding assembly, said RPM dispenser assembly and said adhesive dispenser. said mounting assembly is configured to attach to a vehicle. said RPM installer comprises a forward movement direction aligned with a forward moving direction of said vehicle. said RPM installer comprises a front side associated with said forward movement direction, a rear side, an interior side adjacent with said vehicle, and an exterior side. said sliding assembly is configured attach to and selectively slide relative to said mounting assembly in directions substantially aligned with said forward movement direction. said RPM dispenser assembly and said adhesive dispenser are mounted to a portion of said sliding assembly. said sliding assembly is configured to selectively slide said sliding assembly between a rearward configuration and a forward configuration, each defined relative to said mounting assembly in said forward movement direction. With said sliding assembly in said rearward configuration, said adhesive dispenser is aligned over said marker location. With said sliding assembly in said forward configuration, said RPM dispenser assembly is aligned over said marker location. said adhesive dispenser comprises a dispensing nozzle configured to selectively dispense an adhesive fluid. said RPM installer is configured for aligning said adhesive dispenser of said marker location, dispensing said adhesive fluid on said marker location, aligning said RPM dispenser assembly over said marker location, and dispensing said RPM marker on said marker location using said RPM dispenser assembly. said RPM dispenser assembly comprises an RPM stack cage and a dropper assembly. said RPM stack cage is configured to align and organize one or more of said RPM marker as an RPM stack. said RPM stack cage is configured to encompass a perimeter portion said RPM stack. The lowest said RPM marker of said RPM stack is referred to as a bottom RPM. said RPM stack cage comprises a dispensing slot comprising a bottom portion of said RPM stack cage. said dispensing slot is taller than said bottom RPM and comprises one side being open and configured to allow said bottom RPM to slide outward and toward said dropper assembly. Thus, said RPM stack is configured to allow for said bottom RPM of said RPM stack to be selectively dispensed out of said RPM stack cage. said RPM installer comprises a controller having a memory, one or more processors, and a communication hardware. said memory host a device application configured to control operation of said RPM installer. said device application is stored in said memory and executed in said one or more processors. said RPM dispenser assembly comprises said dropper assembly. said dropper assembly comprises one or more dropper gates. said dropper assembly is configured for: receiving said RPM marker on said one or more dropper gates, transitioning said one or more dropper gates from a substantially horizontal state to a substantially vertical state, and dropping said RPM marker out of said one or more dropper gates. said one or more dropper gates comprise a first dropper gate and a second dropper gate. Each among said one or more dropper gates comprises a rotating axis, a gate platform, and a counterweight. said first dropper gate and said second dropper gate face one another and rotate opposite from one another when transitioning from a holding configuration to a dropping configuration. said gate platform of each gate are substantially aligned with one another when in said holding configuration. said one or more dropper gates comprise a gate gap between said first dropper gate and said second dropper gate. said gate gap is calculated to be smaller than a width of said RPM marker. said gate platform and said counterweight is arranged on opposite sides of said rotating axis. said counterweight acts as a damper when said RPM marker is placed in said one or more dropper gates. said rotating axis comprises an axis created by a hinge between a portion of said gate platform and a fixed portion of said dropper assembly.

An RPM installer for automatically aligning an RPM dispenser assembly and an adhesive dispenser over a marker location on a roadway and installing an RPM marker at said marker location. said RPM installer comprises a mounting assembly, a sliding assembly, said RPM dispenser assembly and said adhesive dispenser. said mounting assembly is configured to attach to a vehicle. said RPM installer comprises a forward movement direction aligned with a forward moving direction of said vehicle. said RPM installer comprises a front side associated with said forward movement direction, a rear side, an interior side adjacent with said vehicle, and an exterior side. said sliding assembly is configured attach to and selectively slide relative to said mounting assembly in directions substantially aligned with said forward movement direction. said RPM dispenser assembly and said adhesive dispenser are mounted to a portion of said sliding assembly. said sliding assembly is configured to selectively slide said sliding assembly between a rearward configuration and a forward configuration, each defined relative to said mounting assembly in said forward movement direction. With said sliding assembly in said rearward configuration, said adhesive dispenser is aligned over said marker location. With said sliding assembly in said forward configuration, said RPM dispenser assembly is aligned over said marker location . . . said adhesive dispenser comprises a dispensing nozzle configured to selectively dispense an adhesive fluid . . . said RPM installer is configured for aligning said adhesive dispenser of said marker location, dispensing said adhesive fluid on said marker location, aligning said RPM dispenser assembly over said marker location, and dispensing said RPM marker on said marker location using said RPM dispenser assembly.

An RPM installer for automatically aligning an RPM dispenser assembly and an adhesive dispenser over a marker location on a roadway and installing an RPM marker at said marker location. said RPM installer comprises a mounting assembly, a sliding assembly, said RPM dispenser assembly and said adhesive dispenser. said mounting assembly is configured to attach to a vehicle. said RPM installer comprises a forward movement direction aligned with a forward moving direction of said vehicle. said RPM installer comprises a front side associated with said forward movement direction, a rear side, an interior side adjacent with said vehicle, and an exterior side. said adhesive dispenser comprises a dispensing nozzle configured to selectively dispense an adhesive fluid. said RPM installer is configured for aligning said adhesive dispenser of said marker location, dispensing said adhesive fluid on said marker location, aligning said RPM dispenser assembly over said marker location, and dispensing said RPM marker on said marker location using said RPM dispenser assembly. said RPM dispenser assembly comprises a dropper assembly. said dropper assembly comprises one or more dropper gates. said dropper assembly is configured for: receiving said RPM marker on said one or more dropper gates, transitioning said one or more dropper gates from a substantially horizontal state to a substantially vertical state, and dropping said RPM marker out of said one or more dropper gates. said one or more dropper gates comprise a first dropper gate and a second dropper gate. Each among said one or more dropper gates comprises a rotating axis, a gate platform, and a counterweight. said first dropper gate and said second dropper gate face one another and rotate opposite from one another when transitioning from a holding configuration to a dropping configuration. said gate platform of each gate are substantially aligned with one another when in said holding configuration. said one or more dropper gates comprise a gate gap between said first dropper gate and said second dropper gate. said gate gap is calculated to be smaller than a width of said RPM marker. said gate platform and said counterweight is arranged on opposite sides of said rotating axis. said counterweight acts as a damper when said RPM marker is placed in said one or more dropper gates. said rotating axis comprises an axis created by a hinge between a portion of said gate platform and a fixed portion of said dropper assembly.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

For purposes of discussion, this disclosure will refer to Raised Pavement Markers as "RPM's", "RPM" or "RPMs".

Figure 1:
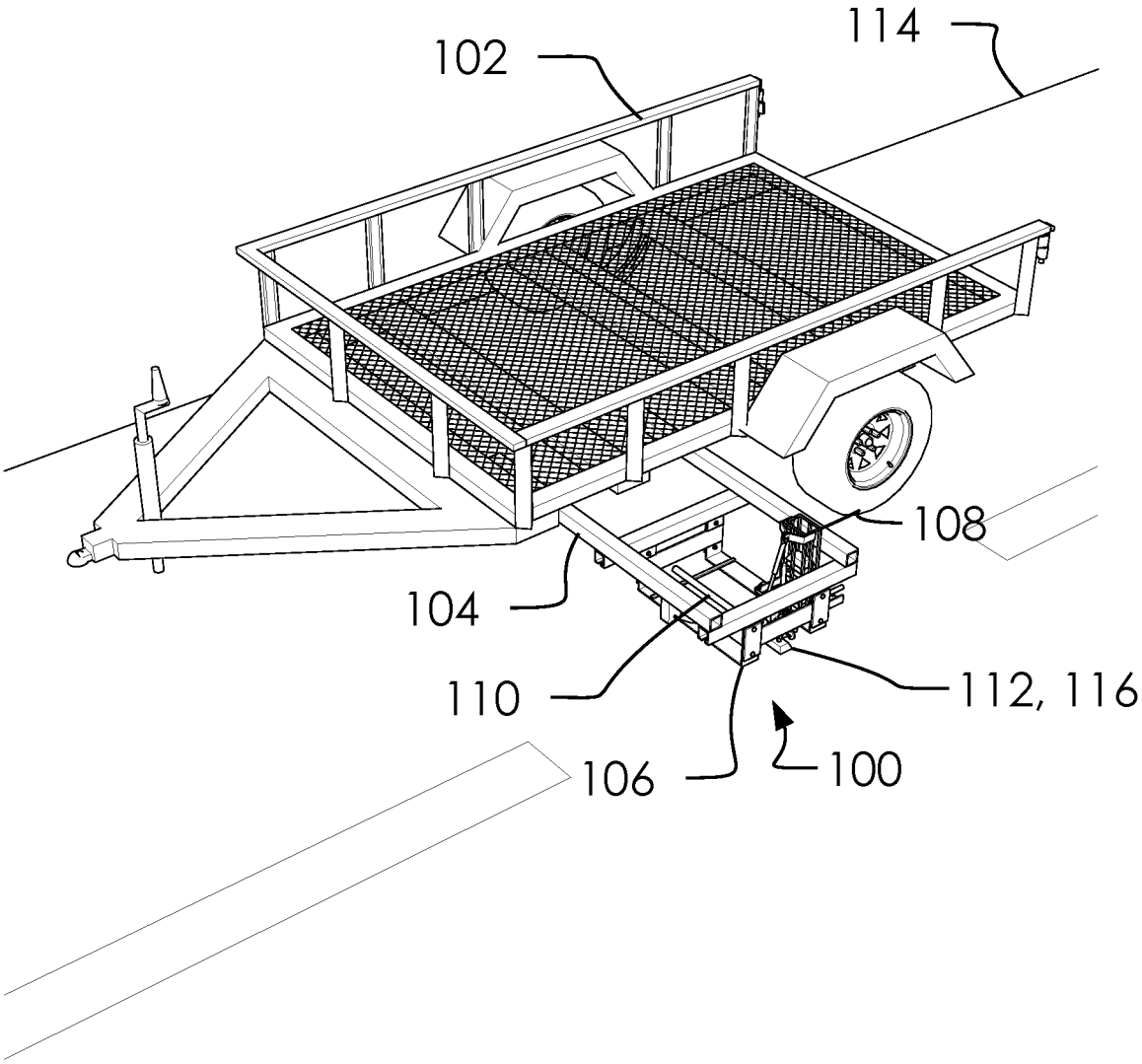
FIG. 1 illustrates a perspective overview of an RPM installer 100 on a trailer 102.

FIG. 1 illustrates a perspective overview of an RPM installer 100 on a trailer 102.

In one embodiment, said RPM installer 100 can comprise a mounting assembly 104, a sliding assembly 106, an RPM dispenser assembly 108 and an adhesive dispenser 110.

One objective of said RPM installer 100 is to automatically align said RPM dispenser assembly 108 and said adhesive dispenser 110 over a marker location 112 on a roadway 114, and installing an RPM marker 116 at said marker location 112.

Figure 2:
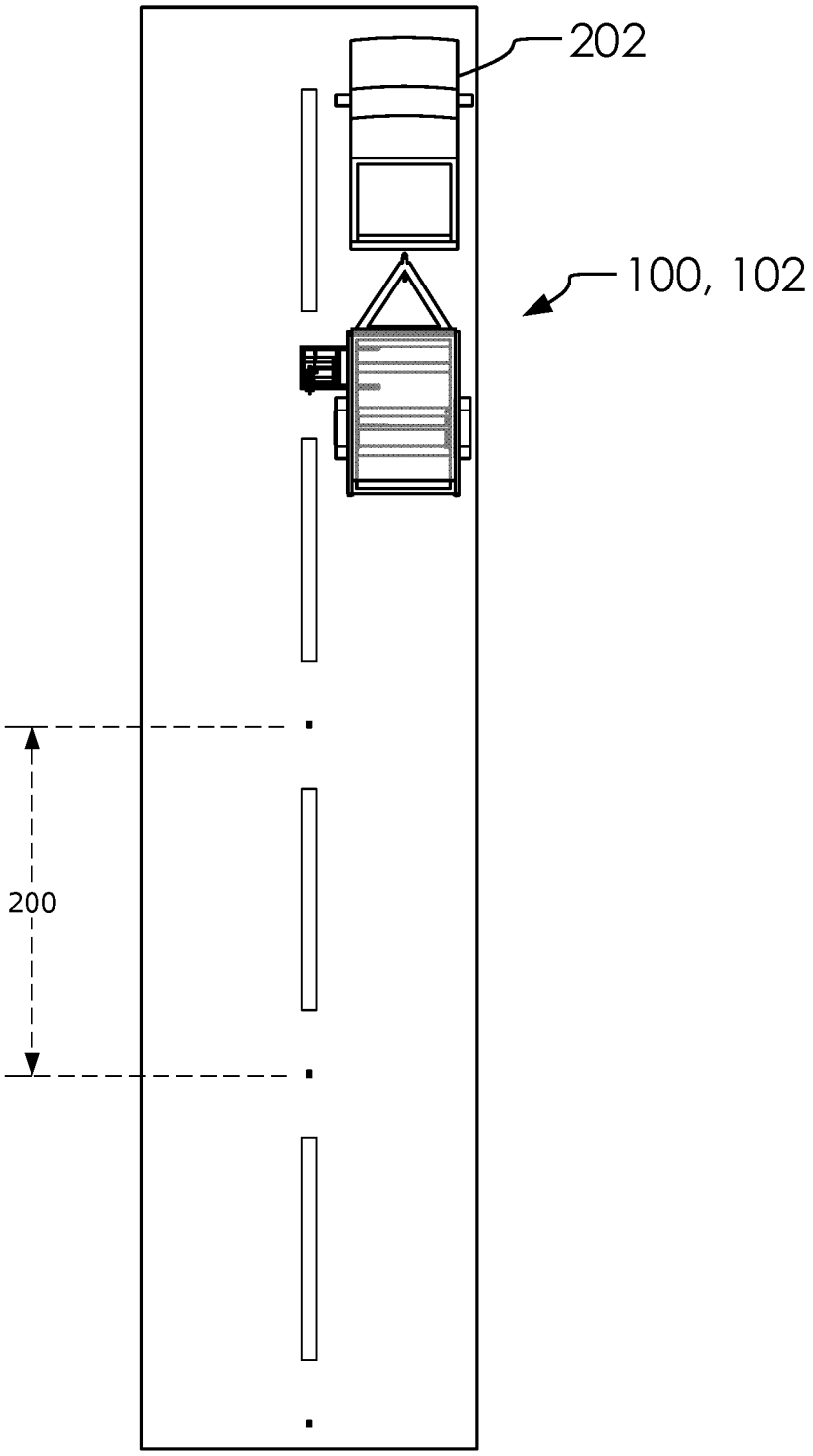
FIG. 2 illustrates an elevated top view of said RPM installer 100 and said trailer 102 on said roadway 114.

FIG. 2 illustrates an elevated top view of said RPM installer 100 and said trailer 102 on said roadway 114.

In one embodiment, said roadway 114 can comprise a plurality of said RPM marker 116, each separated by at a marker spacing 200 and installed at said marker location 112, as is known in the art.

In one embodiment, said RPM installer 100 can mount to said trailer 102 and pulled by a vehicle 202.

Figure 3:
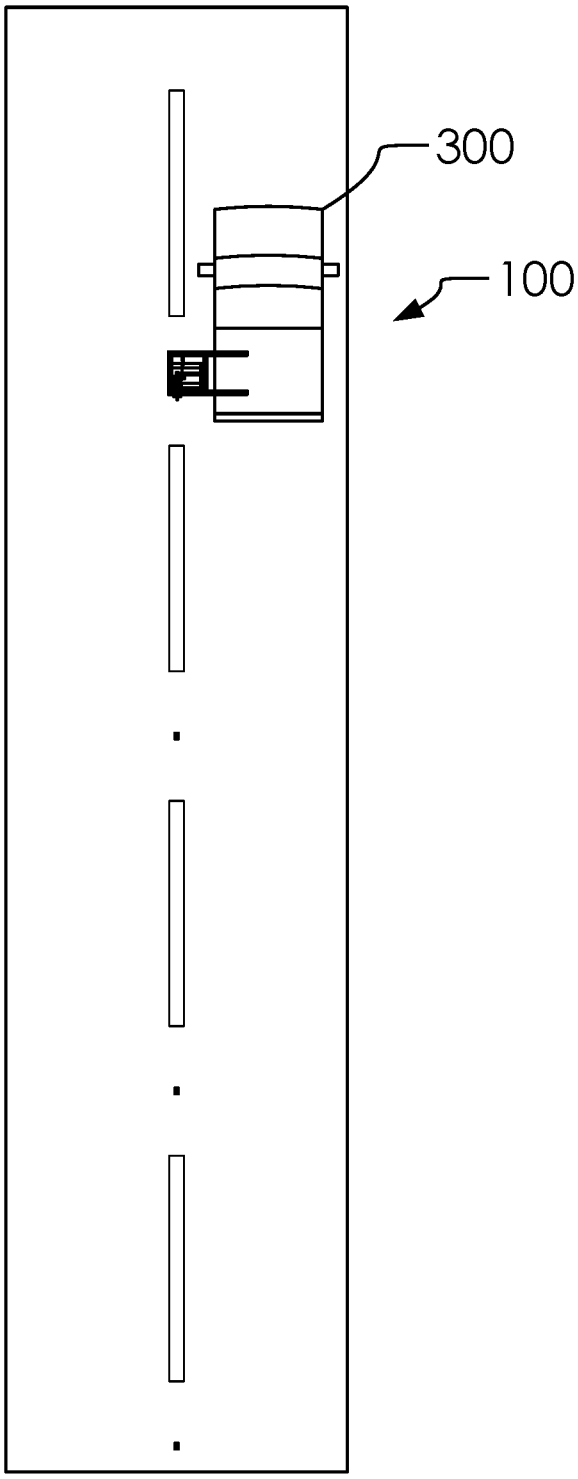
FIG. 3 illustrates said RPM installer 100 installed on a flatbed truck 300.

FIG. 3 illustrates said RPM installer 100 installed on a flatbed truck 300.

In another embodiment, said RPM installer 100 can mount directly to a vehicle, such as a flatbed truck.

Figure 4:
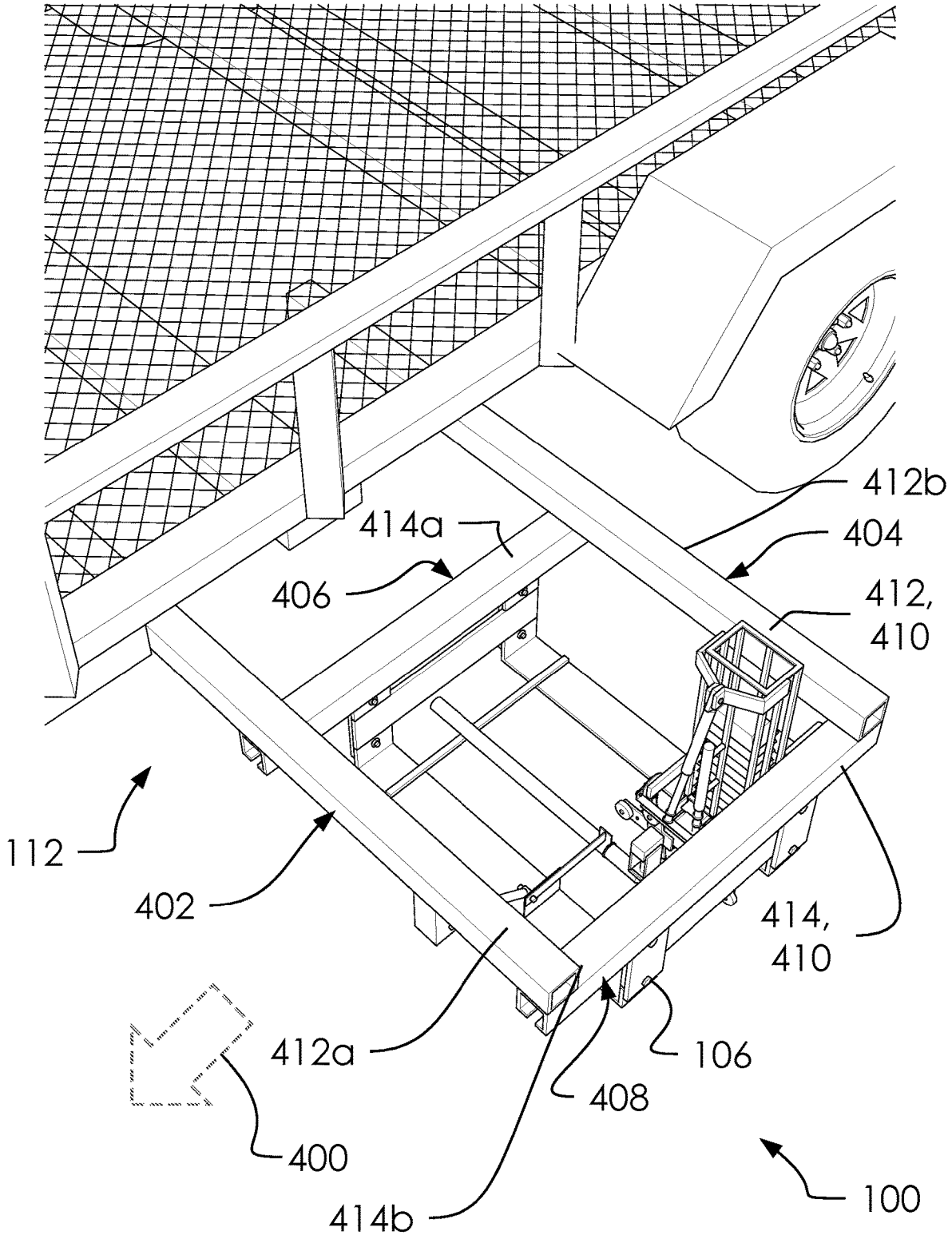
FIG. 4 illustrates a perspective overview of said RPM installer 100 installed on said trailer 102.

FIG. 4 illustrates a perspective overview of said RPM installer 100 installed on said trailer 102.

Said RPM installer 100 can comprise a forward movement direction 400 aligned with a front end of said trailer 102, said vehicle 202 and said flatbed truck 300. Accordingly, said RPM installer 100 can comprise a front side 402, a rear side 404, an interior side 406, and an exterior side 408.

In one embodiment, said mounting assembly 104 can comprise a mounting frame 410 comprising one or more horizontal portions 412 and one or more longitudinal portions 414. In one embodiment, said one or more horizontal portions 412 and said one or more longitudinal portions 414 can be attached to one another at perpendicular angles. Said one or more longitudinal portions 414 can be aligned with said forward movement direction 400.

Said one or more longitudinal portions 414 can comprise a first longitudinal portion 414*a* and a second longitudinal portion 414*b*. Said one or more horizontal portions 412 can comprise a first horizontal portion 412*a* and a second horizontal portion 412*b*.

In one embodiment, said sliding assembly 106 can slidably attach to a portion of said one or more longitudinal portions 414.

Figure 5:
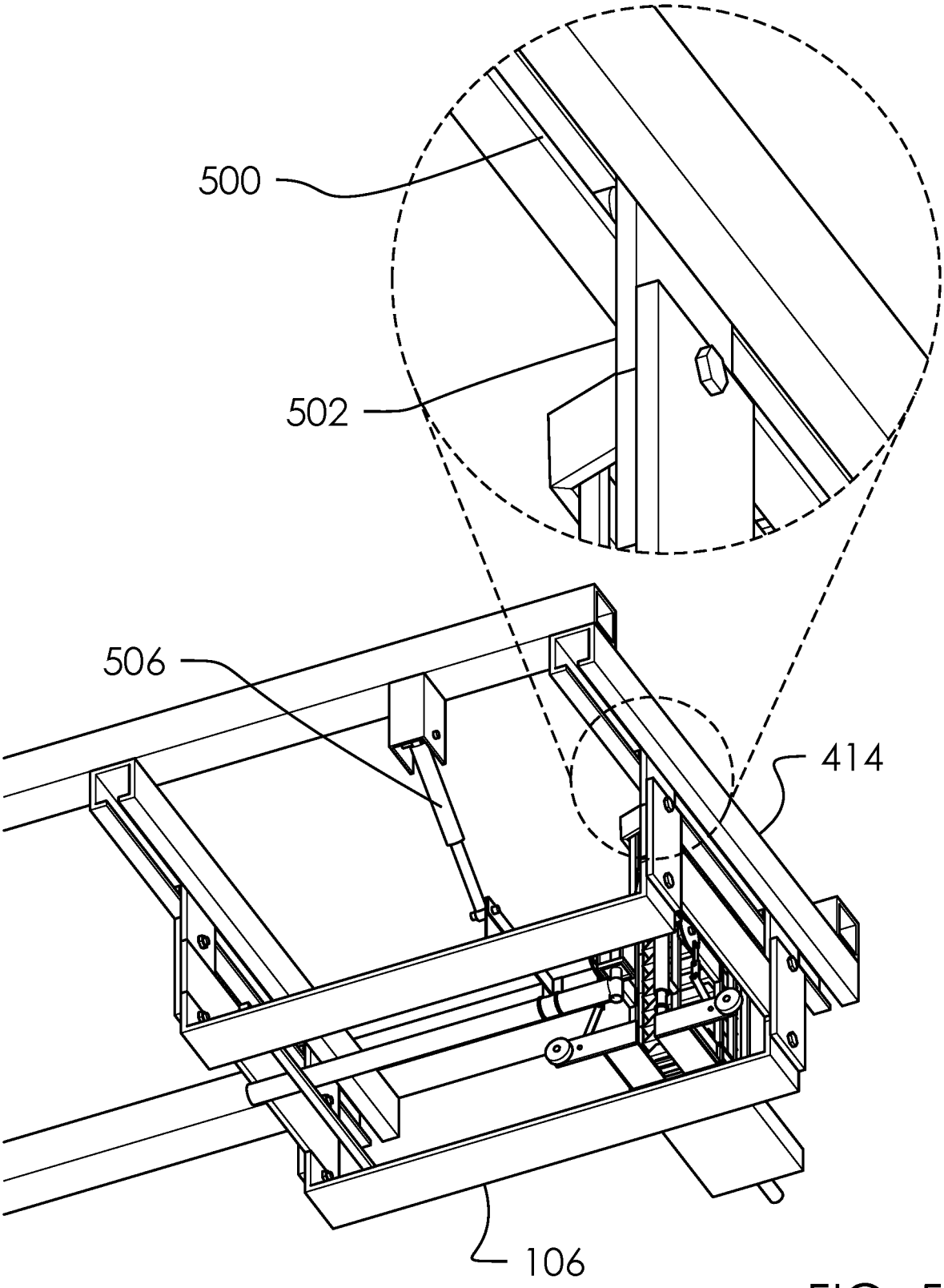
FIG. 5 illustrates a perspective lower view of said RPM installer 100.

FIG. 5 illustrates a perspective lower view of said RPM installer 100.

In one embodiment, said one or more longitudinal portions 414 can comprise a box channel and can further comprise square tubing box channel. Thus, said one or more longitudinal portions 414 can comprise a longitudinal slot 500.

In one embodiment, said sliding assembly 106 can comprise one or more sliding hangers 502 configured to selectively slide within said longitudinal slot 500 of said one or more longitudinal portions 414.

In one embodiment, said sliding assembly 106 can comprise a support frame comprising said one or more sliding hangers 502 connected to one or more horizontal supports 504.

In one embodiment, said RPM installer 100 can comprise a sliding assembly actuator 506 attached at its ends between said mounting assembly 104 and said sliding assembly 106.

In one embodiment, said RPM dispenser assembly 108 and said adhesive dispenser 110 can be mounted to a portion of said sliding assembly 106.

Figure 6A:
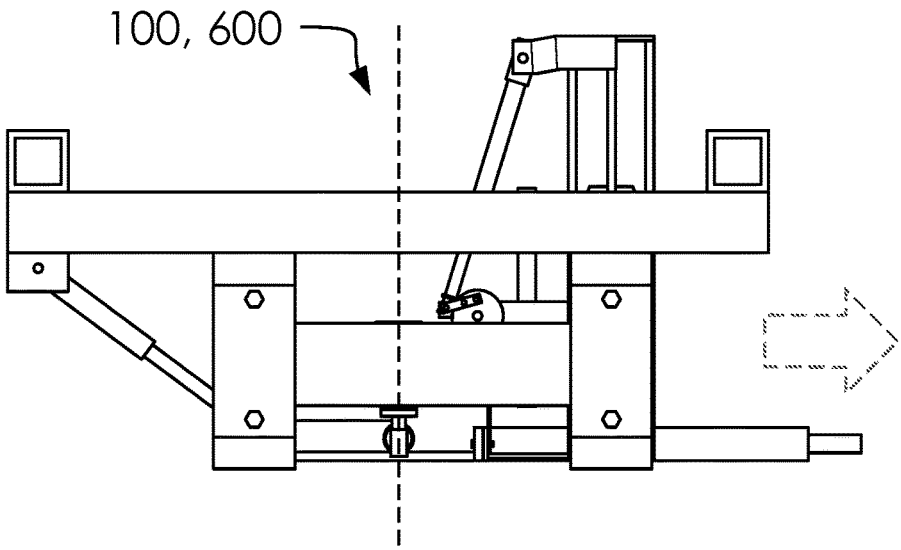
FIGS. 6A and 6B illustrate said RPM installer 100 with said sliding assembly 106 in a rearward configuration 600 and a forward configuration 602, respectively.
Figure 6B:
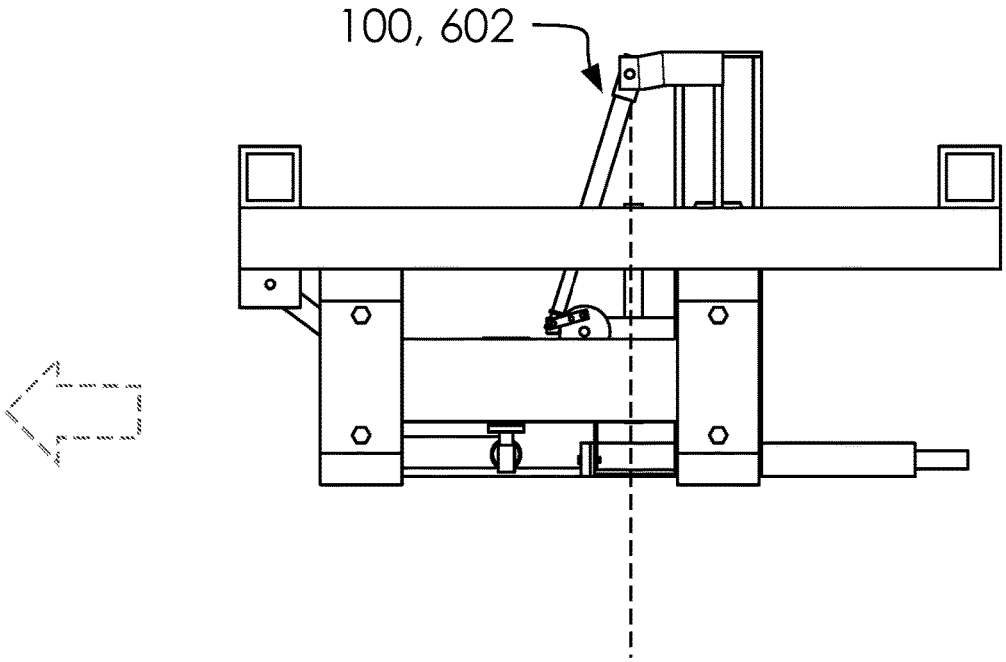

FIGS. 6A and 6B illustrate said RPM installer 100 with said sliding assembly 106 in a rearward configuration 600 and a forward configuration 602, respectively.

In one embodiment, with said sliding assembly 106 in said rearward configuration 600, said adhesive dispenser 110 can be aligned over said marker location 112; and with said sliding assembly 106 in said forward configuration 602, said RPM dispenser assembly 108 can be aligned over said marker location 112.

In one embodiment, said sliding assembly actuator 506 can be configured to selectively slide said sliding assembly 106 between said rearward configuration 600 and said forward configuration 602.

Figure 7A:
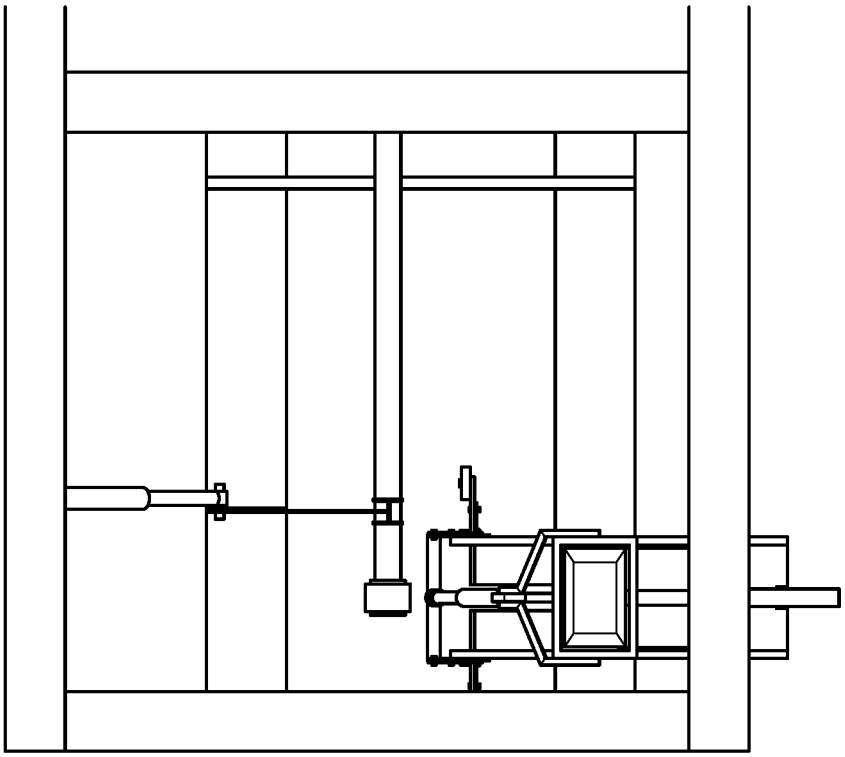
FIGS. 7A and 7B illustrate an elevated top view of said RPM installer 100 in said rearward configuration 600 and said forward configuration 602, respectively.
Figure 7B:
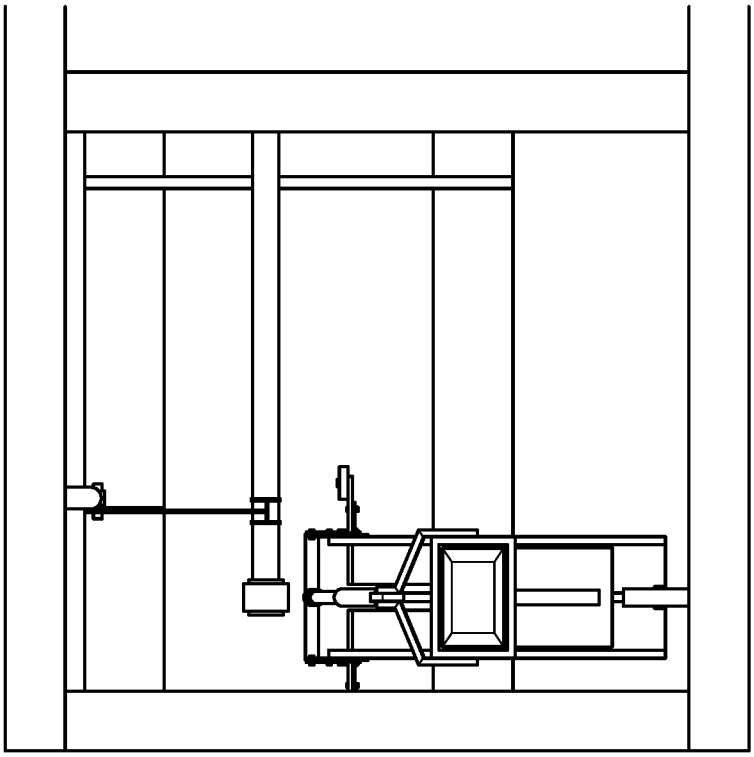

FIGS. 7A and 7B illustrate an elevated top view of said RPM installer 100 in said rearward configuration 600 and said forward configuration 602, respectively.

Figure 8:
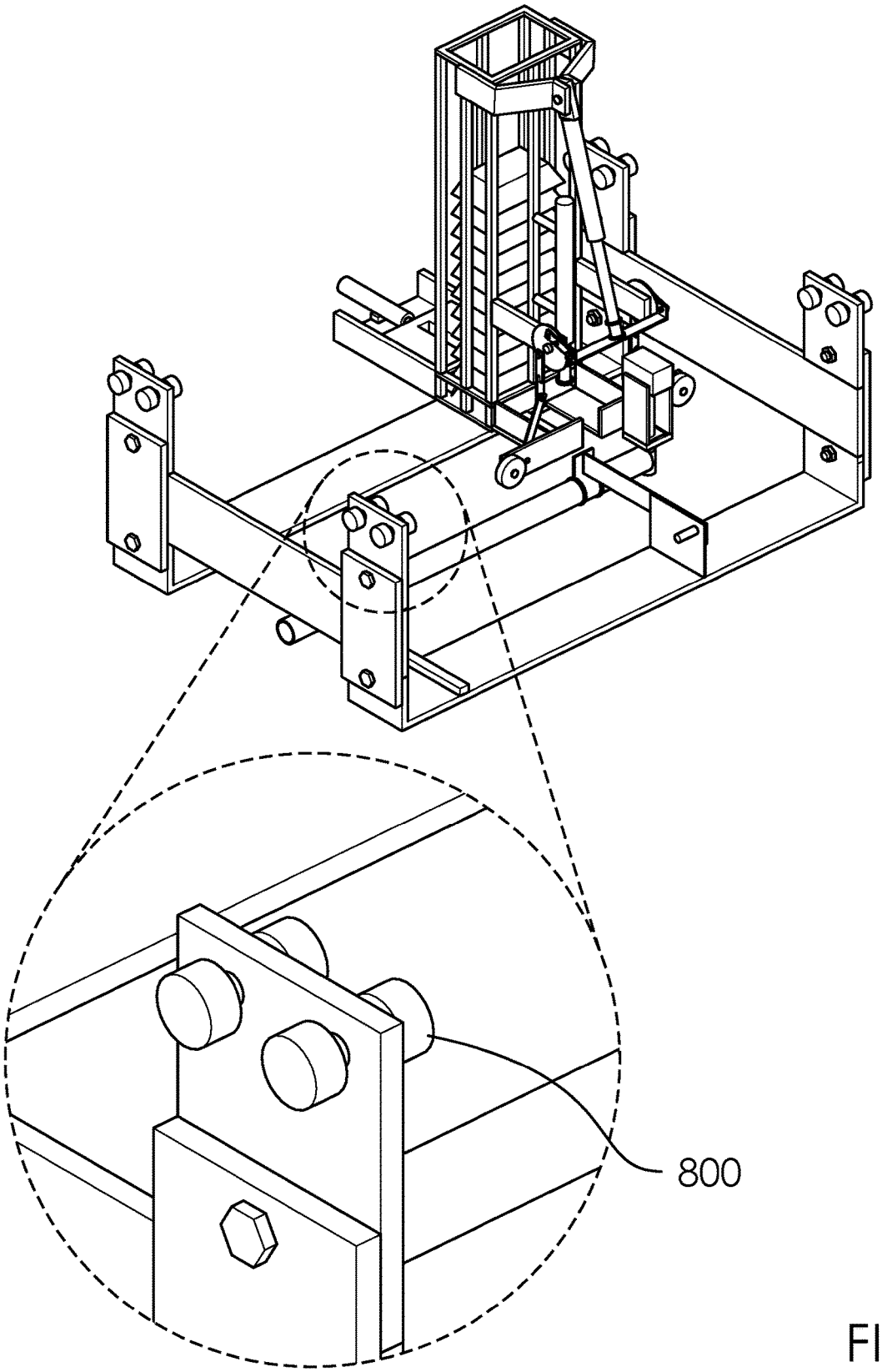
FIG. 8 illustrates a perspective overview of said sliding assembly 106 with detailed view of said one or more sliding hangers 502.

FIG. 8 illustrates a perspective overview of said sliding assembly 106 with detailed view of said one or more sliding hangers 502.

Each among said one or more sliding hangers 502 can comprise a wheel assembly 800 configured to slide within said longitudinal slot 500 of said one or more longitudinal portions 414 aligned with said forward movement direction 400.

In one embodiment, said sliding assembly 106 can hang down from said mounting assembly 104 and slide within said one or more longitudinal portions 414.

Figure 9A:
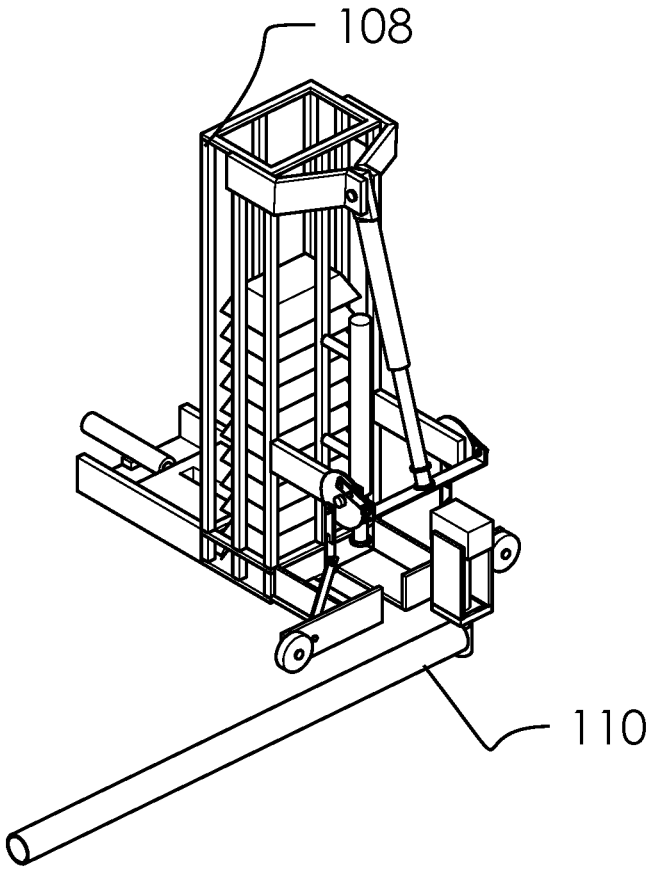
FIGS. 9A and 9B illustrate a perspective overview and an elevated top view of said RPM dispenser assembly 108 and said adhesive dispenser 110.
Figure 9B:
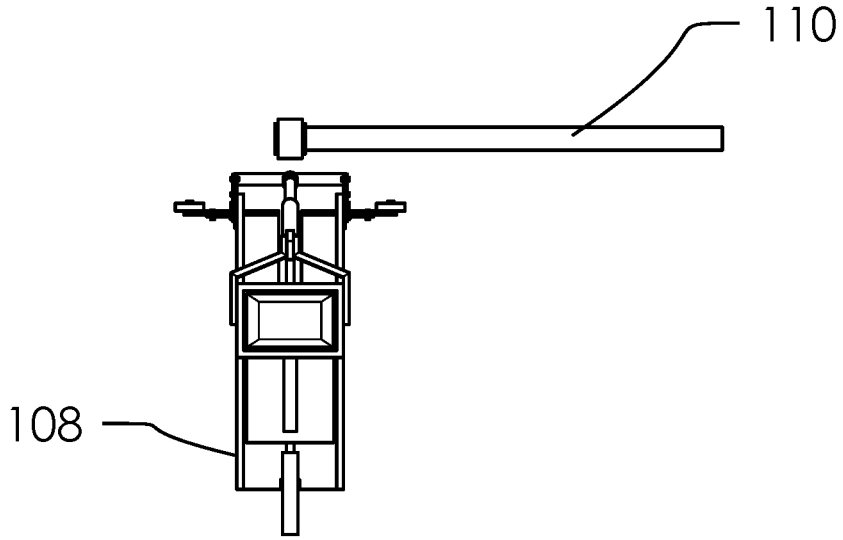

FIGS. 9A and 9B illustrate a perspective overview and an elevated top view of said RPM dispenser assembly 108 and said adhesive dispenser 110.

Figure 10:
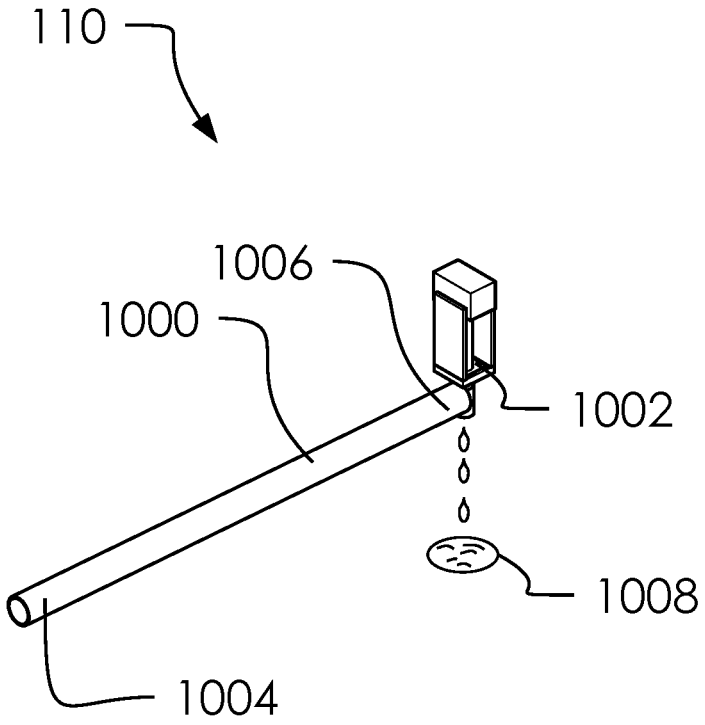
FIG. 10 illustrates a perspective overview of said adhesive dispenser 110.
Figure 11A:
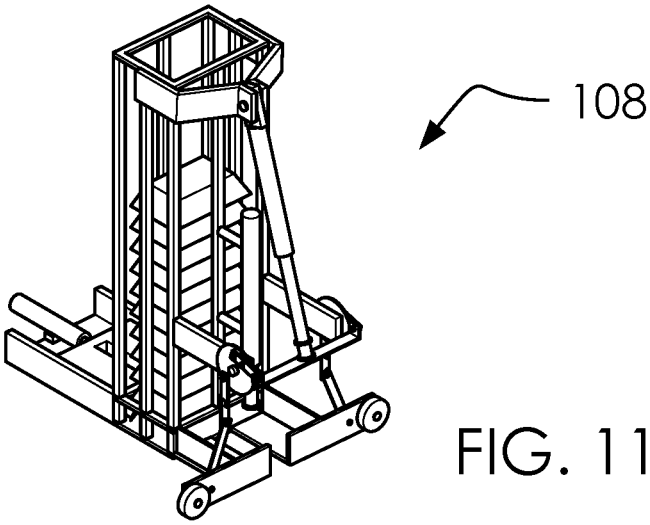
FIGS. 11A, 11B, 11C and 11D illustrate a perspective overview, elevated side view, front and top view of said RPM dispenser assembly 108.
Figure 11B:
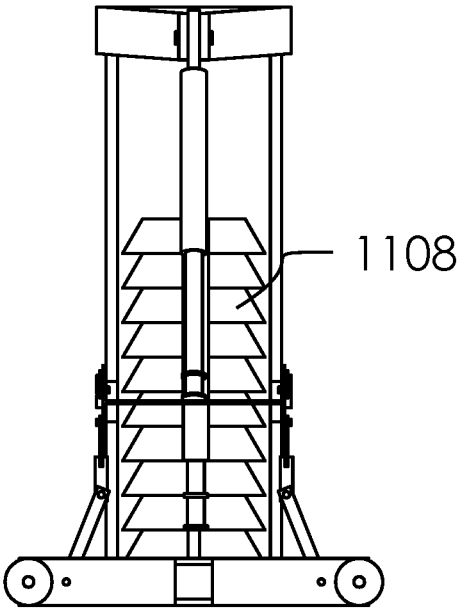
Figure 11C:
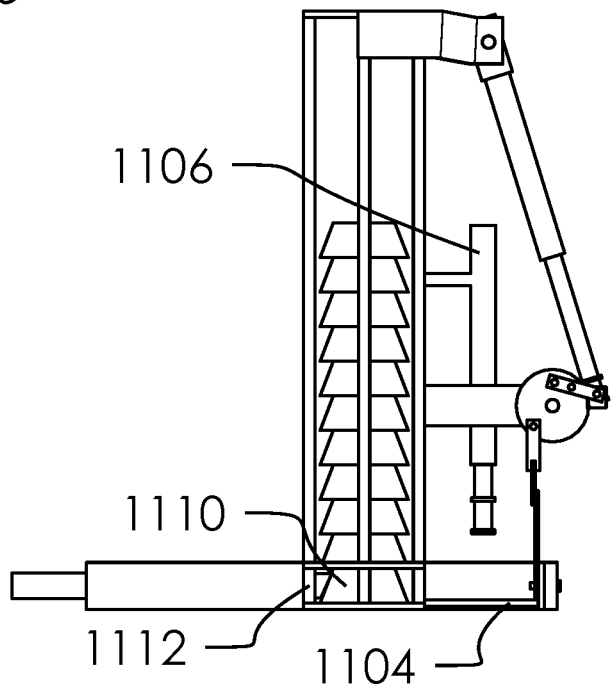
Figure 11D:
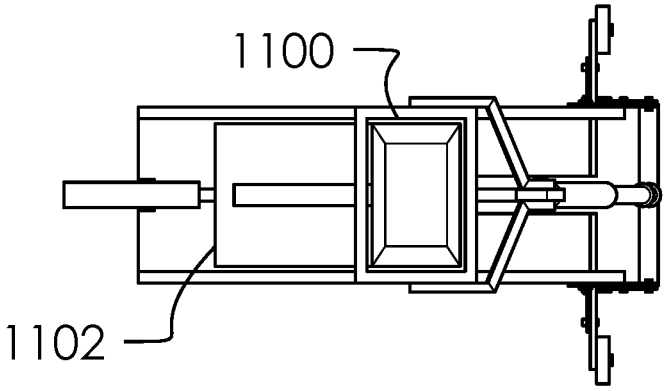

FIG. 10 illustrates a perspective overview of said adhesive dispenser 110.

In one embodiment, said adhesive dispenser 110 can comprise a fluid input 1000 and a dispensing nozzle 1002. In one embodiment, said fluid input 1000 can comprise a pipe having a proximate end 1004 and a distal end 1006. In one embodiment, said proximate end 1004 can receive an adhesive fluid 1008, such as road tars, and said distal end 1006 can attach to said dispensing nozzle 1002. In one embodiment, said RPM installer 100 can be configured to selectively dispense said adhesive fluid 1008.

FIGS. 11A, 11B, 11C and 11D illustrate a perspective overview, elevated side view, front and top view of said RPM dispenser assembly 108.

In one embodiment, said RPM dispenser assembly 108 can comprise an RPM stack cage 1100, a pusher assembly 1102, a dropper assembly 1104, and a masher assembly 1106.

In one embodiment, said RPM stack cage 1100 can encompass an RPM stack 1108. Said RPM stack 1108 can comprise a plurality of said RPM marker 116. Said RPM stack cage 1100 can be configured to encompass said RPM stack 1108 about their perimeter, and allow for a bottom RPM 1110 of said RPM stack 1108 to be selectively dispensed out of said RPM stack cage 1100 with a portion of said dropper assembly 1104.

In one embodiment, a portion of said pusher assembly 1102 can press against said bottom RPM 1110 to load it into a portion of said dropper assembly 1104.

In one embodiment, said RPM stack cage 1100 can comprise a dispensing slot 1112 comprising a bottom portion of said RPM stack cage 1100. In one embodiment, said dispensing slot 1112 can be taller than said bottom RPM 1110 and can comprise one side being open to allow said bottom RPM 1110 to slide outward and toward said dropper assembly 1104. In one embodiment, said dropper assembly 1104 can be configured to push said bottom RPM 1110 through an open portion of said dispensing slot 1112 and into said dropper assembly 1104.

Figure 12:
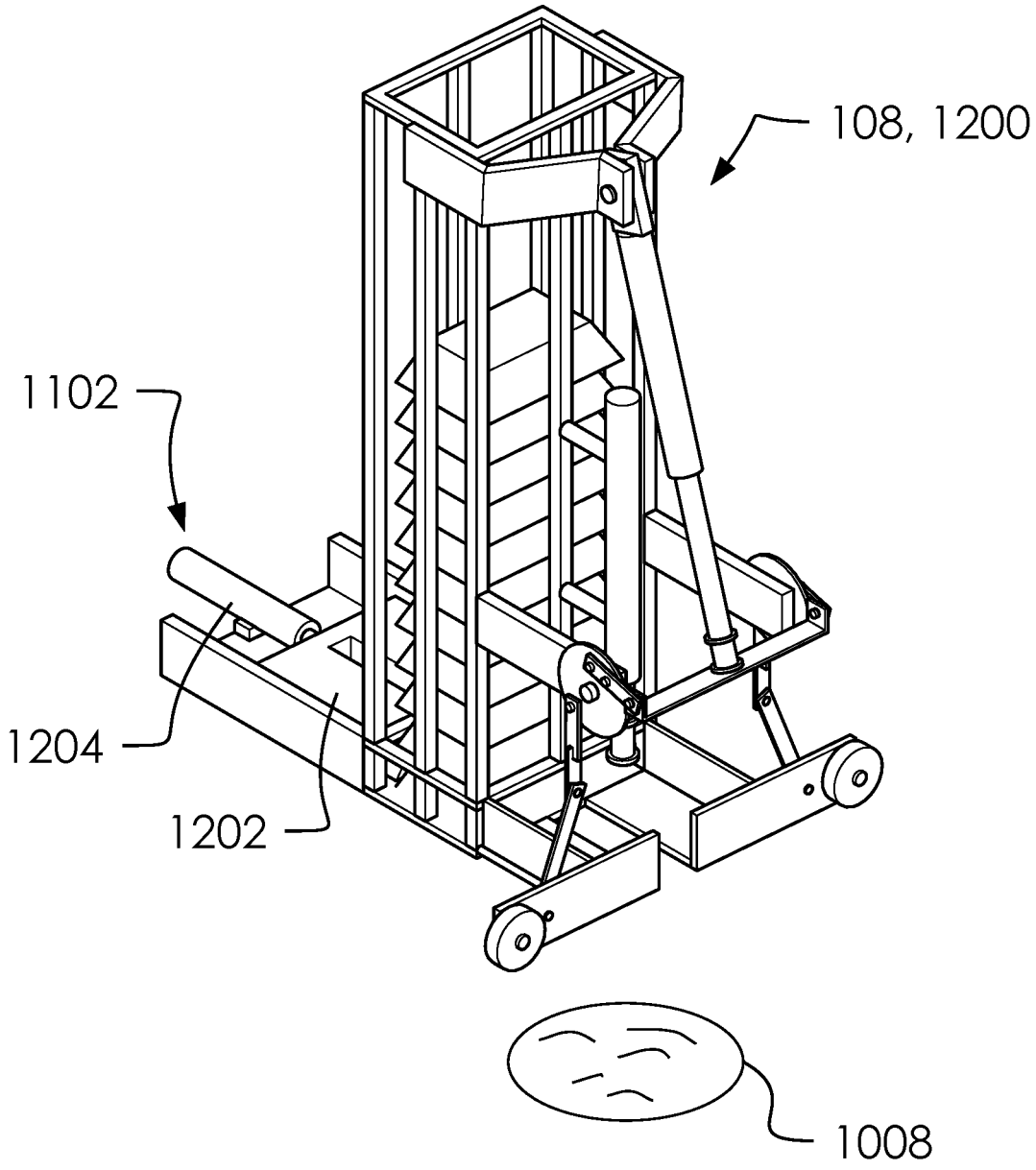
FIG. 12 illustrates a perspective overview of said RPM dispenser assembly 108 in a ready configuration 1200.

FIG. 12 illustrates a perspective overview of said RPM dispenser assembly 108 in a ready configuration 1200.

In one embodiment, said pusher assembly 1102 can comprise a pusher body 1202 and a pusher actuator 1204. In one embodiment, said pusher actuator 1204 can be activated and deactivated to adjust a condition of said pusher assembly 1102.

Figure 13:
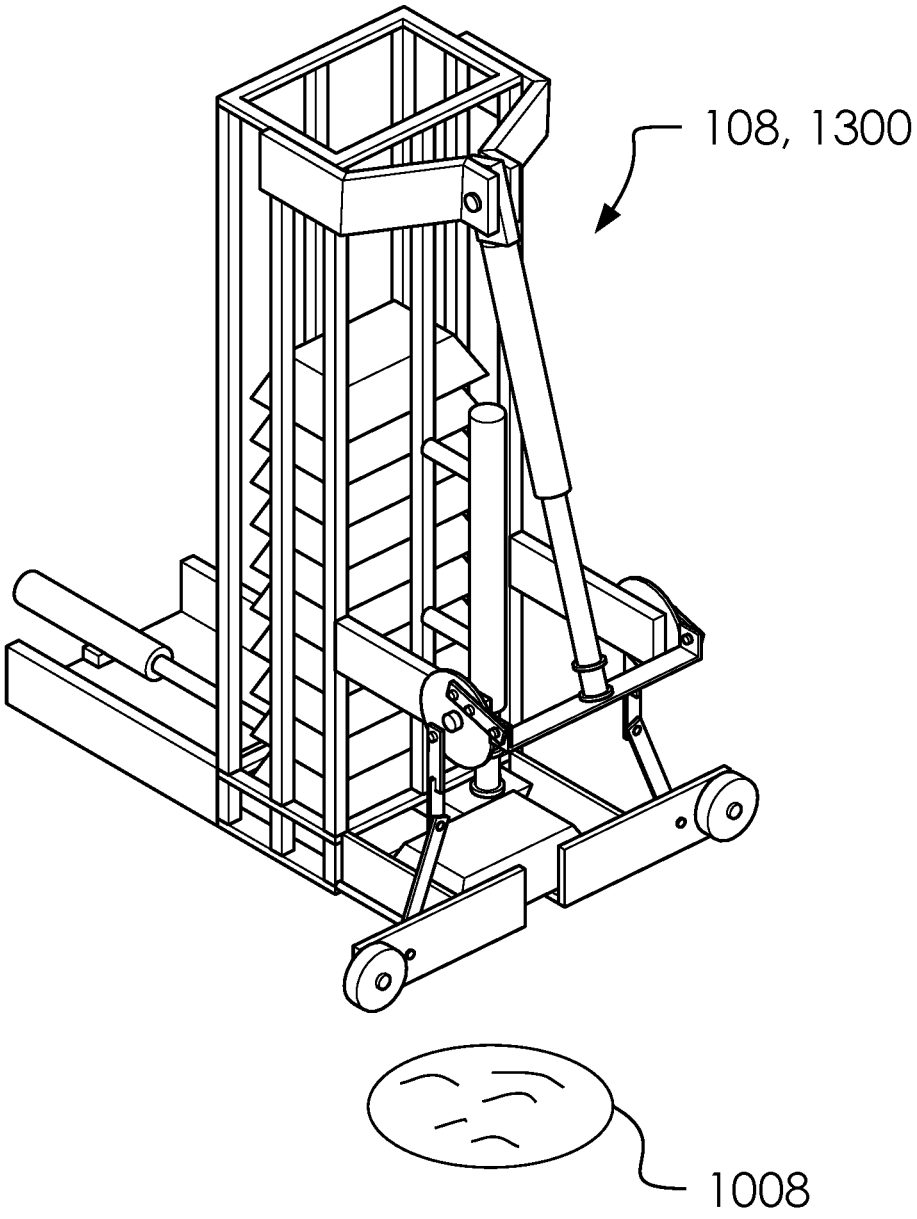
FIG. 13 illustrates a perspective overview of said RPM dispenser assembly 108 a loaded configuration 1300 with said bottom RPM 1110 loaded into said dropper assembly 1104.

FIG. 13 illustrates a perspective overview of said RPM dispenser assembly 108 a loaded configuration 1300 with said bottom RPM 1110 loaded into said dropper assembly 1104.

In one embodiment, said loaded configuration 1300 comprises activating said pusher actuator 1204 of said pusher assembly 1102 to push said bottom RPM 1110 from said RPM stack cage 1100 onto said dropper assembly 1104.

Figure 14:
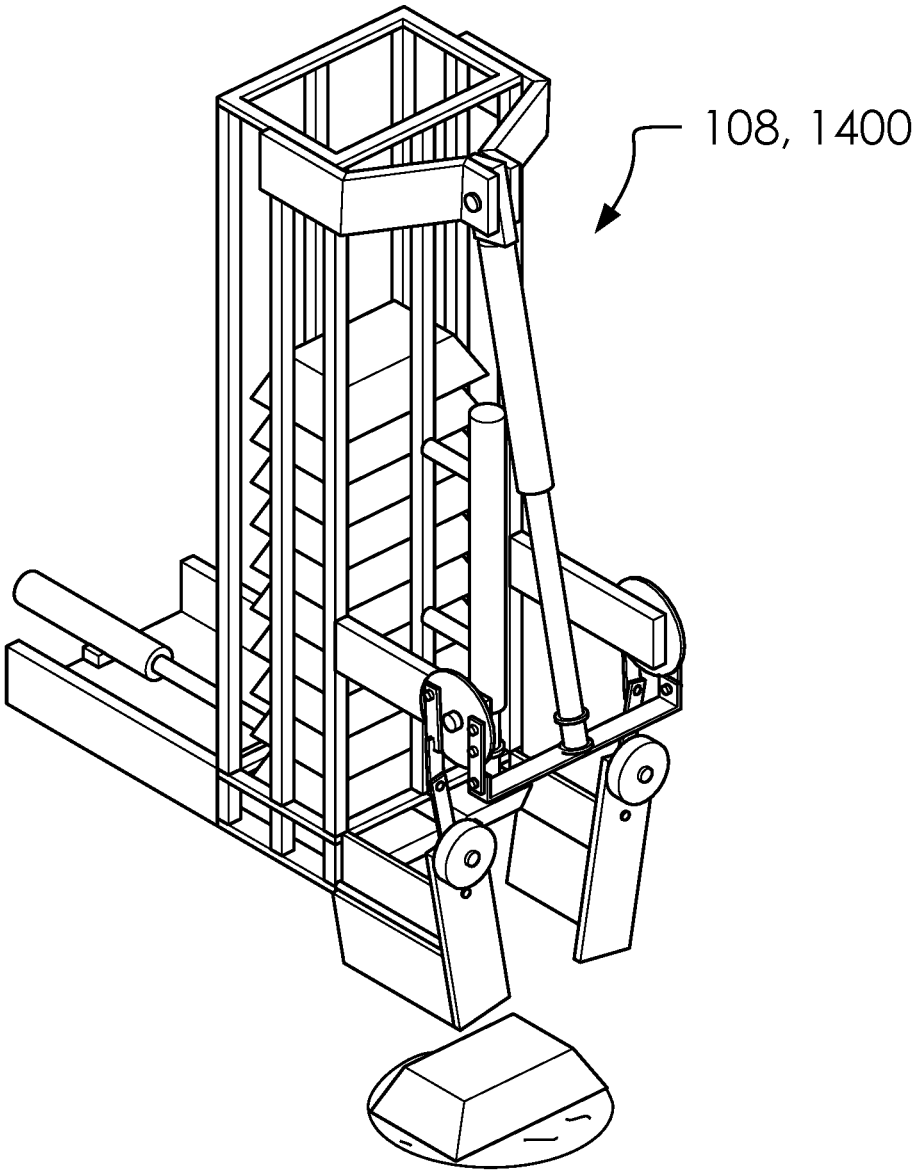
FIG. 14 illustrates a perspective overview of said RPM dispenser assembly 108 with said bottom RPM 1110 dropped below said dropper assembly 1104 and said dropper assembly 1104 in a dropped configuration 1400.

FIG. 14 illustrates a perspective overview of said RPM dispenser assembly 108 with said bottom RPM 1110 dropped below said dropper assembly 1104 and said dropper assembly 1104 in a dropped configuration 1400.

Figure 15:
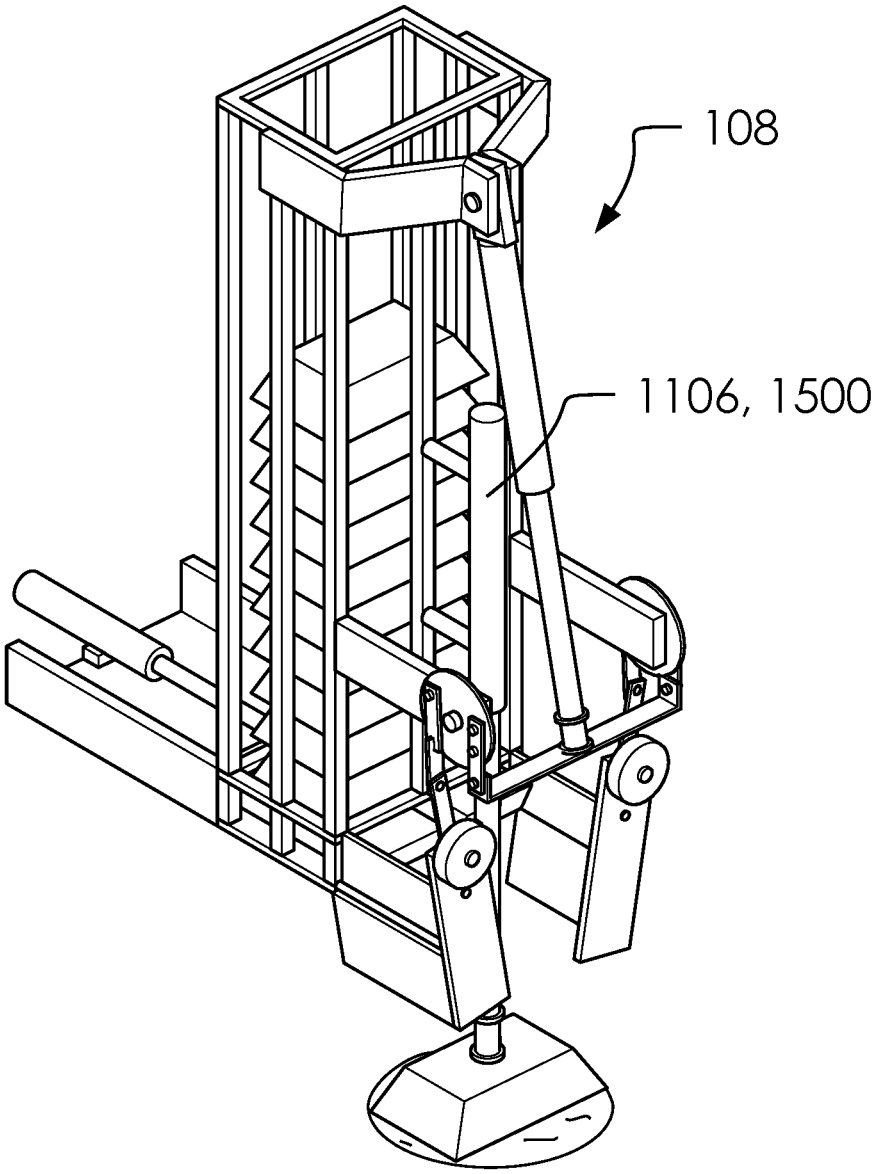
FIG. 15 illustrates a perspective overview of said RPM dispenser assembly 108 with said masher assembly 1106 in an engaged configuration 1500.

FIG. 15 illustrates a perspective overview of said RPM dispenser assembly 108 with said masher assembly 1106 in an engaged configuration 1500.

Figure 16:
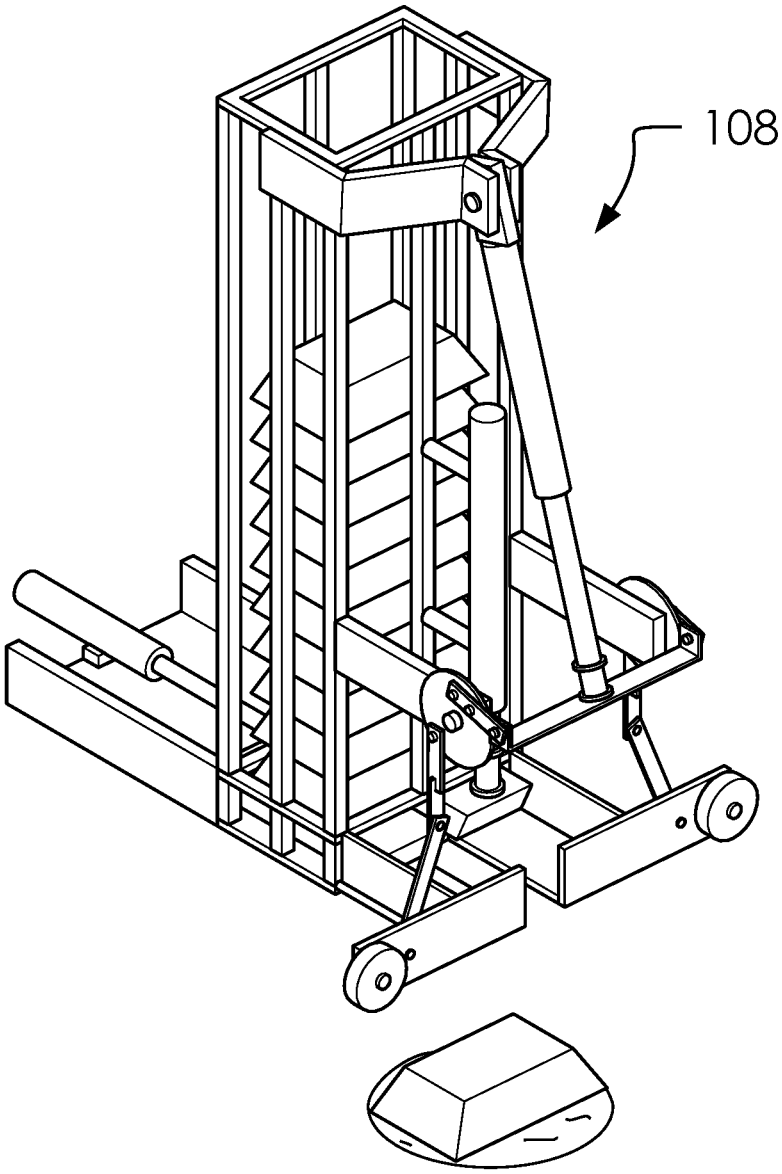
FIG. 16 illustrates a perspective overview of said RPM dispenser assembly 108 with said bottom RPM 1110 installed on said adhesive fluid 1008.

FIG. 16 illustrates a perspective overview of said RPM dispenser assembly 108 with said bottom RPM 1110 installed on said adhesive fluid 1008.

Figure 17:
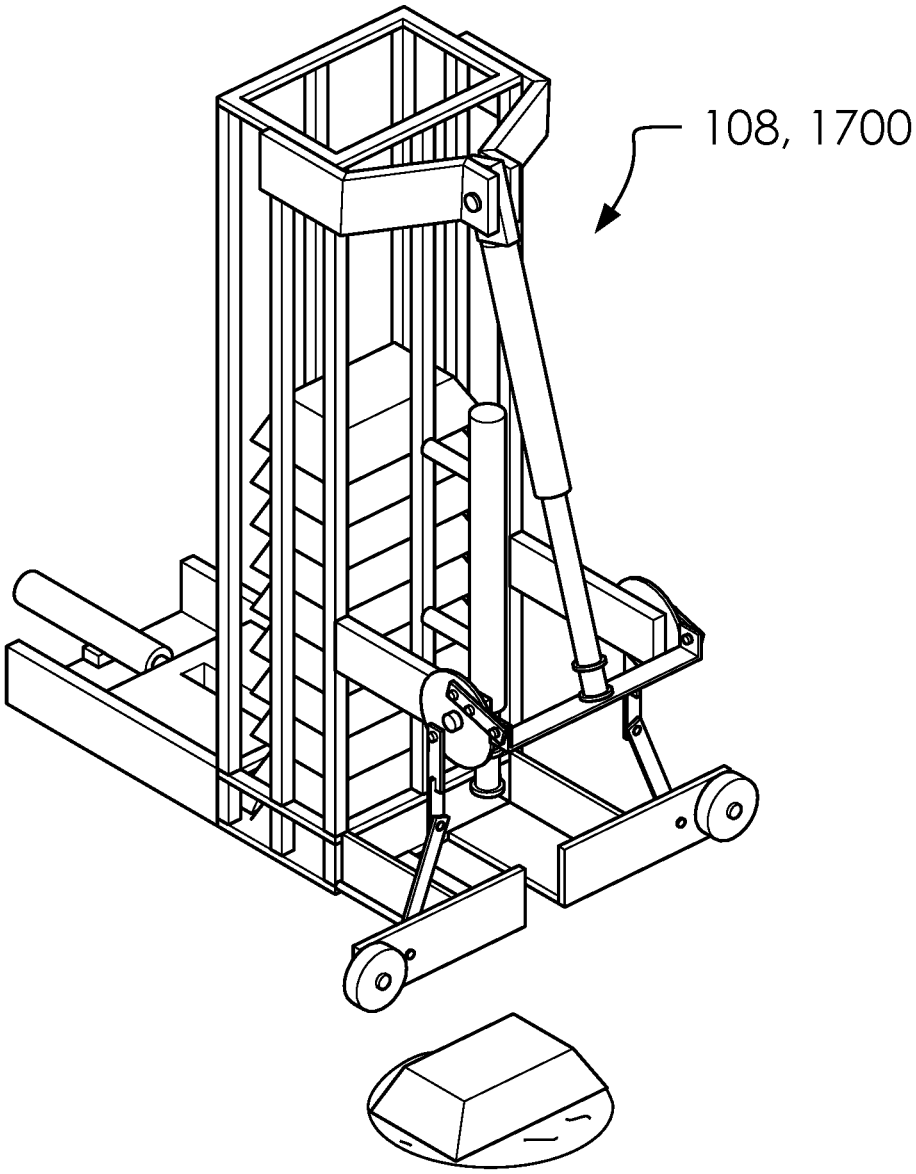
FIG. 17 illustrates a perspective overview of said RPM dispenser assembly 108 in a reset configuration 1700.

FIG. 17 illustrates a perspective overview of said RPM dispenser assembly 108 in a reset configuration 1700.

Figure 18:
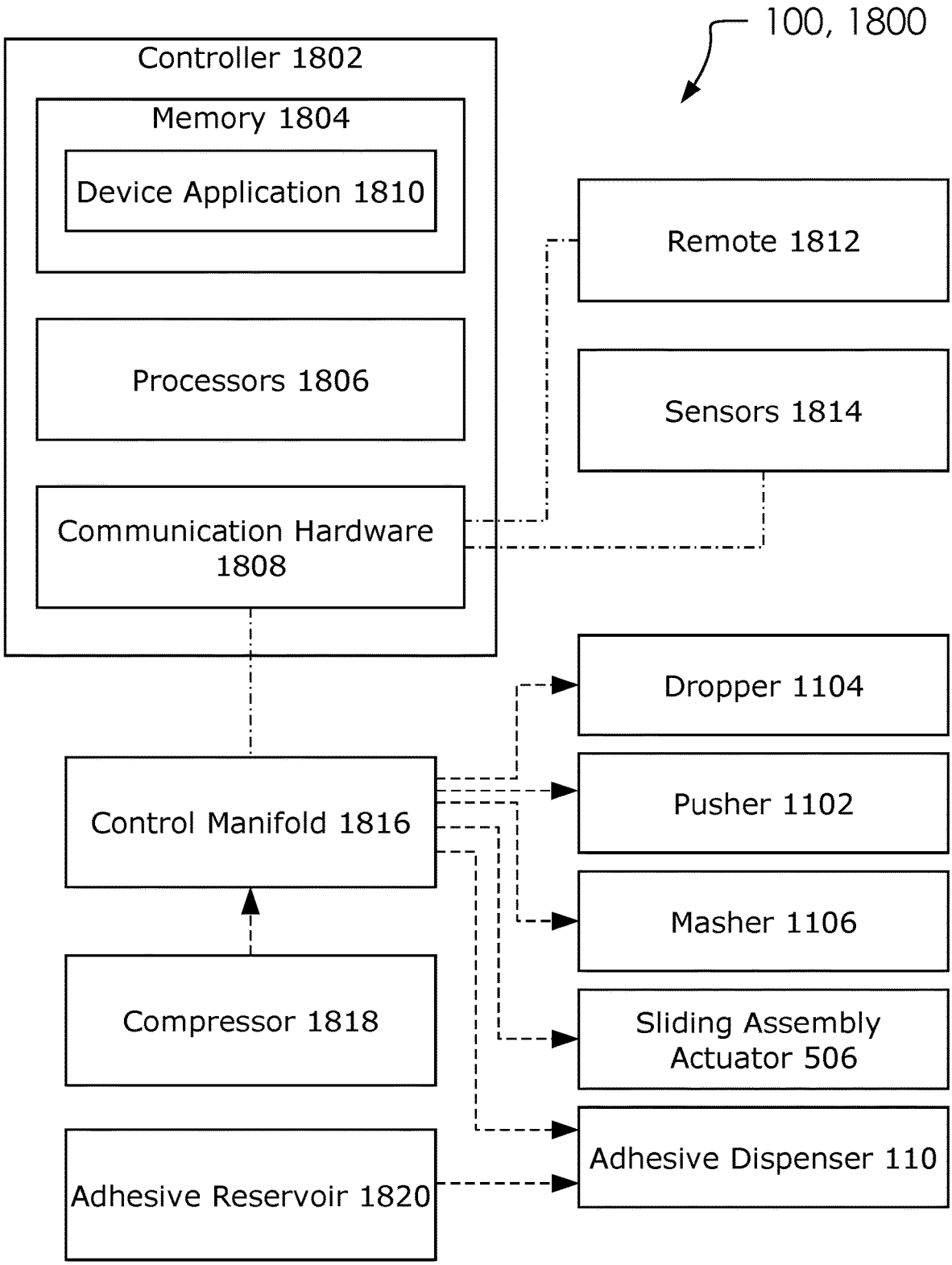
FIG. 18 illustrates a block diagram 1800 of said RPM installer 100.
Figure 19A:
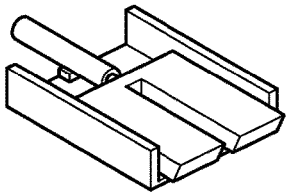
FIGS. 19A, 19B, 19C, 19D and 19E illustrate five perspective overviews of said pusher assembly 1102 and said RPM stack cage 1100.
Figure 19B:
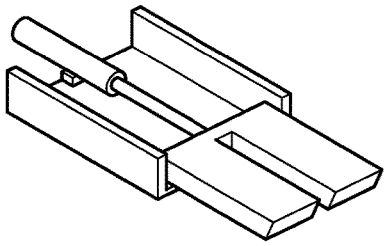
Figure 19C:
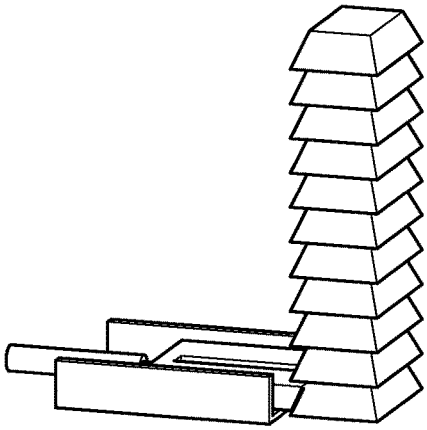
Figure 19D:
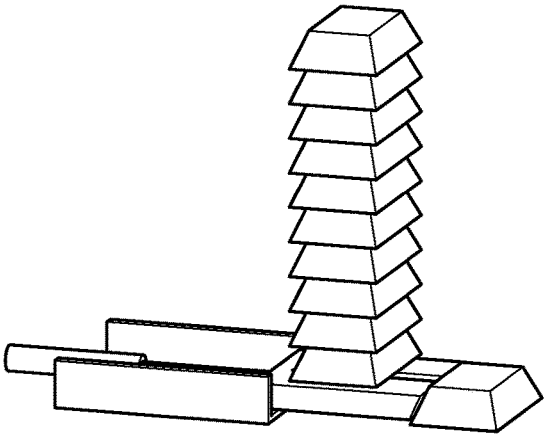
Figure 19E:
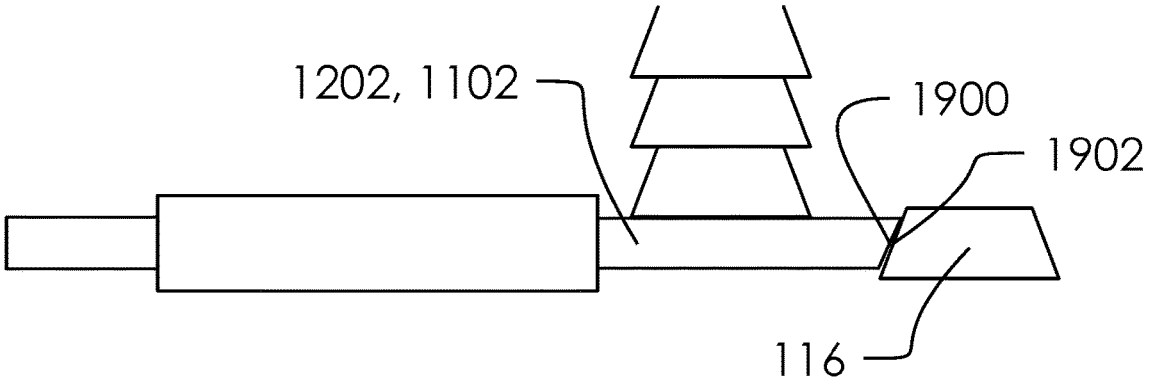

FIG. 18 illustrates a block diagram 1800 of said RPM installer 100.

In one embodiment, said RPM installer 100 can comprise a controller 1802 having a memory 1804, one or more processors 1806, and a communication hardware 1808. Said memory 1804 can host a device application 1810 configured to control operation of said RPM installer 100 and monitor performance.

In one embodiment, said device application 1810 can be stored in said memory 1804 and executed in said one or more processors 1806. In one embodiment, said device application 1810 can be in communication with a remote computer using said communication hardware 1808 such as Wi-Fi, cellular, or similar.

In one embodiment, said communication hardware 1808 can comprise a remote 1812 comprising a simple input to activate and deactivate said RPM installer 100. For example, where a user is driving said vehicle 202, it may be advantageous to position a portion of said RPM installer 100 over said marker location 112, and activate said RPM installer 100 using said remote 1812 to engage said RPM dispenser assembly 108 and said adhesive dispenser 110.

In one embodiment, said controller 1802 can be stored on said trailer 102, said vehicle 202 and said flatbed truck 300. In another embodiment, said controller 1802 can be integrated into portions of said RPM installer 100 such as said mounting assembly 104 and said sliding assembly 106.

In one embodiment, said RPM installer 100 can further comprise one or more sensors 1814, a control manifold 1816, a compressor 1818, and an adhesive reservoir 1820.

In one embodiment, said one or more sensors 1814 can monitor performance of said RPM installer 100 and ensure said adhesive fluid 1008 and said RPM marker 116 are installed correctly and at a desired spot such as said marker location 112. Examples of said one or more sensors 1814 can comprise digital cameras in communication with said device application 1810, GPS to measure said marker spacing 200, lidar to scan portions of said roadway 114, and similar.

In one embodiment, actuators used in said RPM installer 100 can comprise pneumatic actuators, linear actuators, or similar. In one embodiment, compressed air can be used to activate and deactivate such actuators. Accordingly, said RPM installer 100.

In one embodiment, said adhesive reservoir 1820 can be in fluid connection with said dispensing nozzle 1002 of said adhesive dispenser 110 and activating a portion of said adhesive dispenser 110 with said compressor 1818 can open and close a valve associated with said dispensing nozzle 1002.

In another embodiment, each of actuators can be electrical or driven by other means as would be obvious to one in the art; for example, said adhesive dispenser 110, said sliding assembly actuator 506 and said pusher assembly 1102, said dropper assembly 1104 and said masher assembly 1106.

FIGS. 19A, 19B, 19C, 19D and 19E illustrate four perspective overviews and an elevated side of said pusher assembly 1102 and said RPM stack cage 1100.

In one embodiment, said pusher body 1202 of said pusher assembly 1102 can comprise a distal pushing face 1900 and said RPM marker 116 can comprise a first side 1902; wherein, with said pusher assembly 1102 and said RPM marker 116 in said dropper assembly 1104, said distal pushing face 1900 and said first side 1902 are substantially aligned; and further wherein, said distal pushing face 1900 and said first side 1902 can be substantially aligned in a plane so as to form a similar angular shape relative to one another.

Figure 20A:
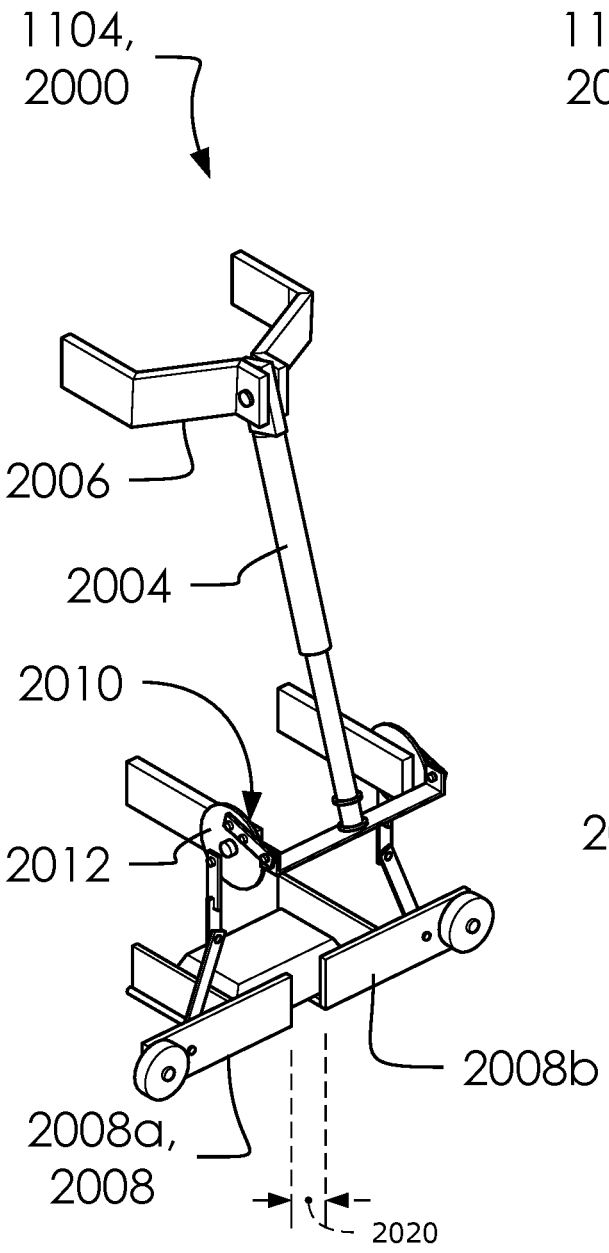
FIGS. 20A and 20B illustrate a perspective overview of said dropper assembly 1104 in a holding configuration 2000 and a dropping configuration 2002.
Figure 20B:
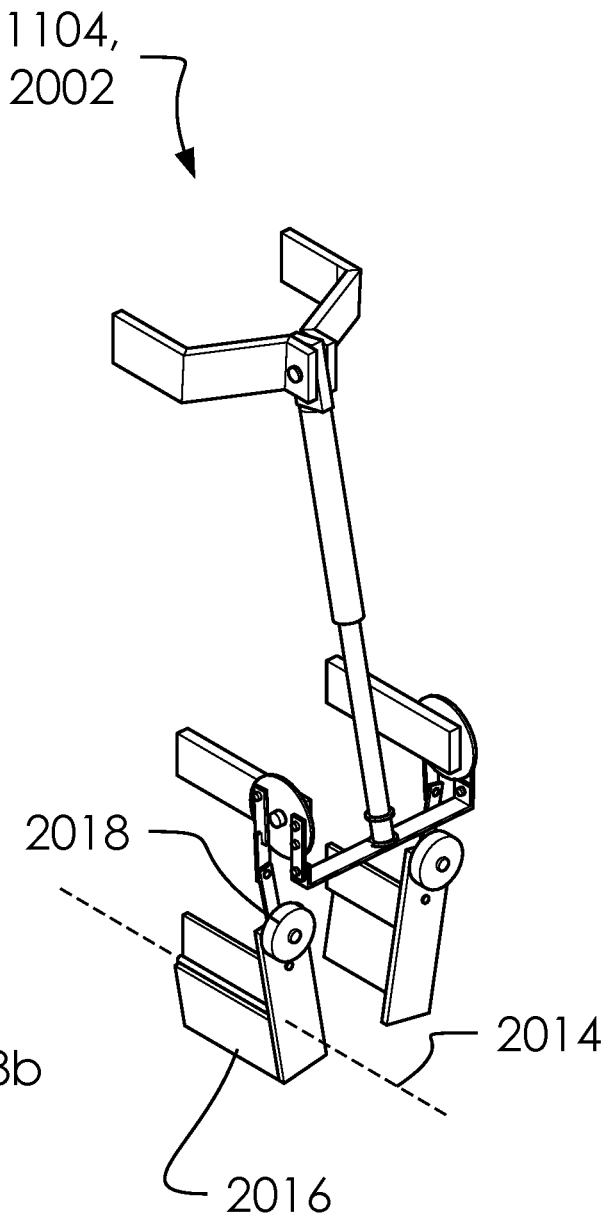

FIGS. 20A and 20B illustrate a perspective overview of said dropper assembly 1104 in a holding configuration 2000 and a dropping configuration 2002.

In one embodiment, said dropper assembly 1104 can comprise a dropper actuator 2004, a first end mounting bracket 2006, one or more dropper gates 2008, and an actuator-trigger transfer assembly 2010. Said one or more dropper gates 2008 can comprise a first dropper gate 2008*a* and a second dropper gate 2008*b*.

In one embodiment, said dropper assembly 1104 can be configured for: activating said dropper actuator 2004 to extend and press a portion of said actuator-trigger transfer assembly 2010, pressing a portion of said actuator-trigger transfer assembly 2010 causes said one or more dropper gates 2008 to transition from a substantially horizontal state to a substantially vertical state, and dropping said RPM marker 116 out of said one or more dropper gates 2008.

In one embodiment, said actuator-trigger transfer assembly 2010 can comprise a rotary element 2012 configured to pull a portion of said one or more dropper gates 2008 when said dropper actuator 2004 is pressing on another portion of said rotary element 2012.

In one embodiment, each among said one or more dropper gates 2008 can comprise a rotating axis 2014, a gate platform 2016, and a counterweight 2018.

In one embodiment, said first dropper gate 2008*a* and said second dropper gate 2008*b* can face one another and rotate opposite from one another when transitioning from said holding configuration 2000 to said dropping configuration 2002. Wherein, said gate platform 2016 of each gate are substantially aligned with one another when in said holding configuration 2000. Further wherein, said gates can comprise a gate gap 2020 between said gate platform 2016 of each gate. In one embodiment, said gate gap 2020 is wide enough to allow a masher actuator 2206 to pass through said dropper assembly 1104 without getting caught on said gate platform 2016 regardless the configuration of said dropper assembly 1104.

In one embodiment, said gate gap 2020 can be calculated to be smaller than a width of said RPM marker 116. Further, in one embodiment, said gate gap 2020 can be optimized to ensure a minimal amount of surface area of said RPM marker 116 contacts said gate platform 2016 so ensure a smooth exit from said dropper assembly 1104 when dropping said RPM marker 116.

One advantage of using two gates (said first dropper gate 2008*a* and said second dropper gate 2008*b*) can comprise the ability to accurately drop said RPM marker 116 through said gate gap 2020, wherein using a single gate may drop said RPM marker 116 at an angle and away from said marker location 112.

In one embodiment, said gate platform 2016 and said counterweight 2018 can be arranged on opposite sides of said rotating axis 2014. Wherein, said gate platform 2016 can act as a damper when said RPM marker 116 is placed in said one or more dropper gates 2008.

In one embodiment, said rotating axis 2014 can comprise an axis created by a hinge between a portion of said gate platform 2016 and a fixed portion of said dropper assembly 1104.

Figure 21A:
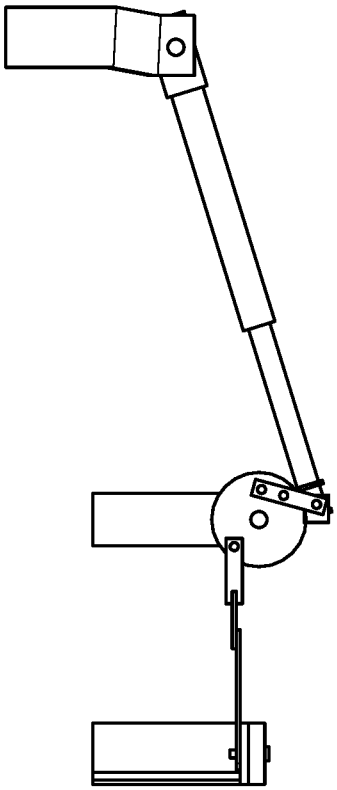
FIGS. 21A and 21B illustrate an elevated side view of said dropper assembly 1104 in said holding configuration 2000 and said dropping configuration 2002.
Figure 21B:
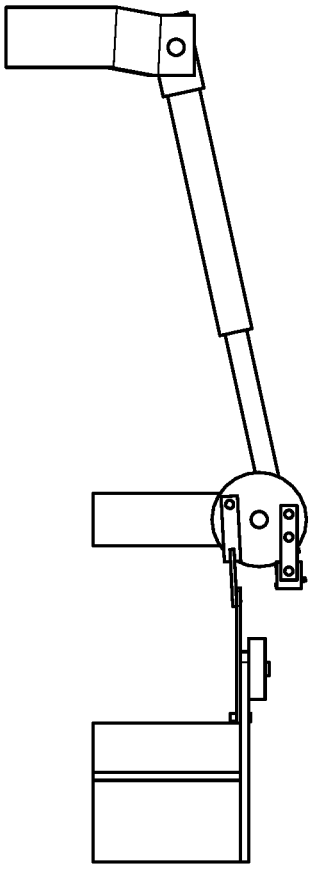

FIGS. 21A and 21B illustrate an elevated side view of said dropper assembly 1104 in said holding configuration 2000 and said dropping configuration 2002.

Figure 22A:
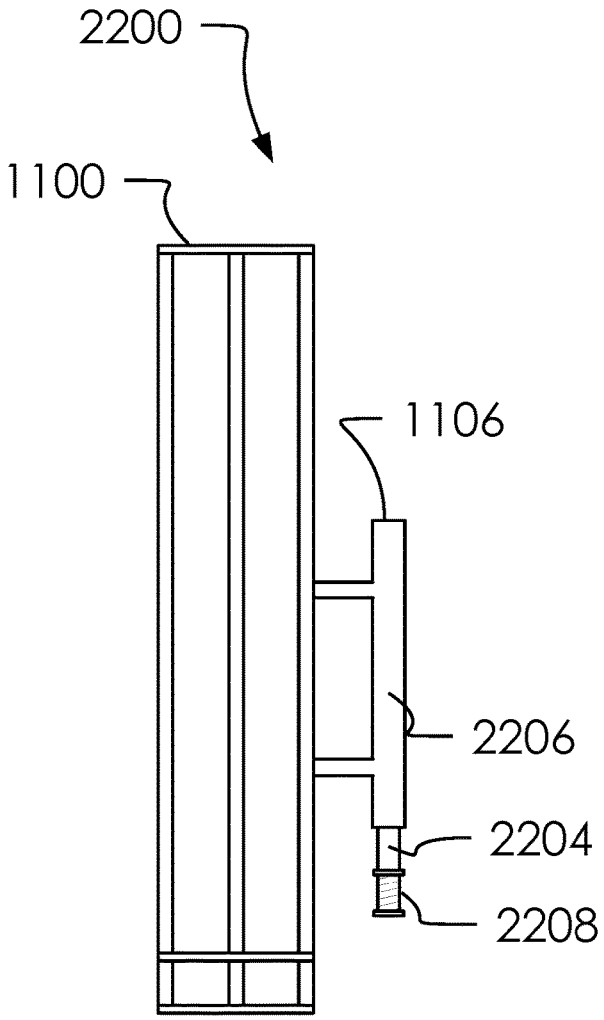
FIGS. 22A and 22B illustrate an elevated side view of said RPM stack cage 1100 and said masher assembly 1106 with said masher assembly 1106 in a retracted configuration 2200 and in a mashing configuration 2202.
Figure 22B:
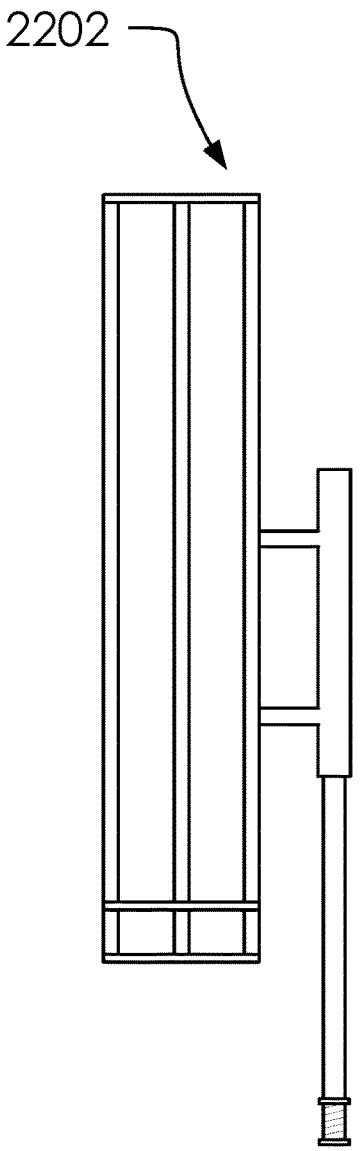

FIGS. 22A and 22B illustrate an elevated side view of said RPM stack cage 1100 and said masher assembly 1106 with said masher assembly 1106 in a retracted configuration 2200 and in a mashing configuration 2202.

In one embodiment, said masher assembly 1106 can comprise a mashing extension 2204, said masher actuator 2206, and a spring head 2208.

In one embodiment, said mashing configuration 2202 can comprise said mashing extension 2204 extended down toward said marker location 112 and pressing said RPM marker 116 to secure the same to said roadway 114 and said adhesive fluid 1008; and said retracted configuration 2200 can comprise said mashing extension 2204 pulled out of the way of said dropper assembly 1104.

In one embodiment, said masher actuator 2206 can extend and contract said mashing extension 2204. Said spring head 2208 can soften a pressing action when applied to said RPM marker 116 to prevent damage to parts of said RPM installer 100, such as said masher assembly 1106 and specifically said mashing extension 2204.

Figure 23A:
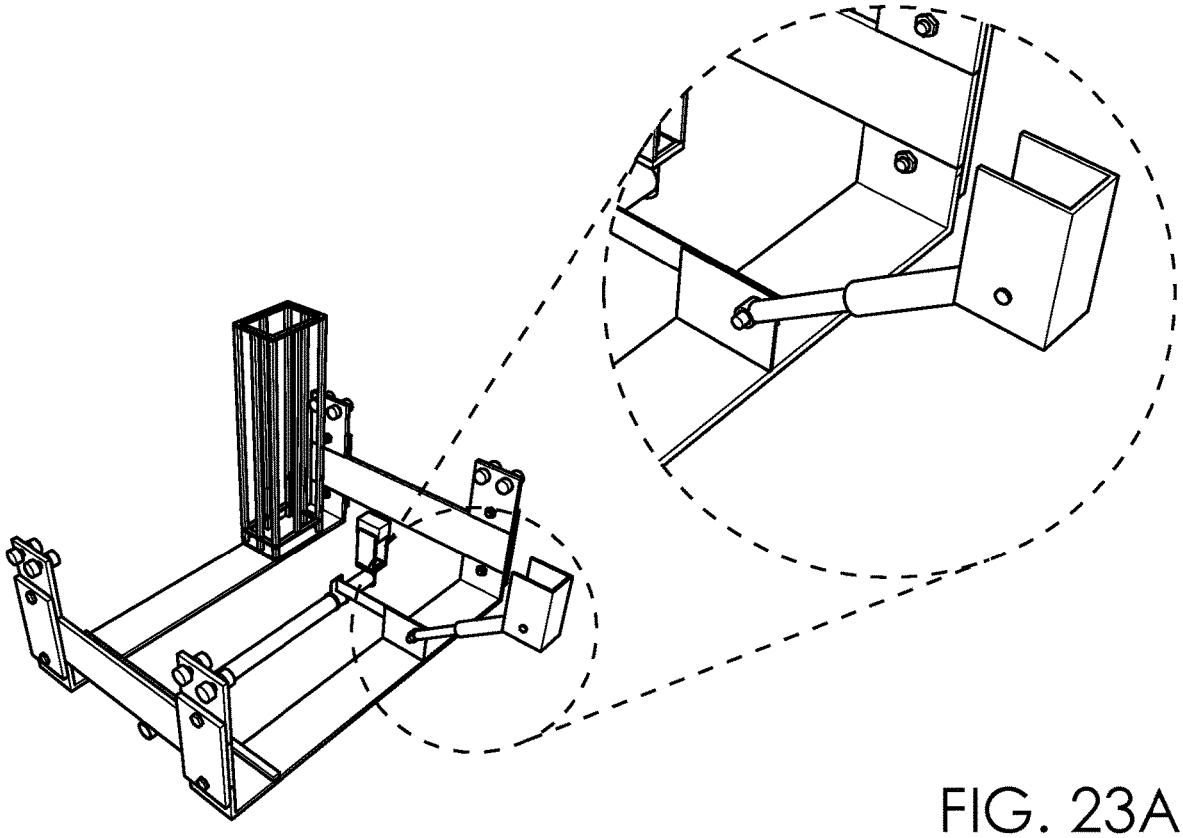
FIGS. 23A and 23B illustrate said sliding assembly actuator 506 in with said sliding assembly 106 in said rearward configuration 600 and said forward configuration 602.
Figure 23B:
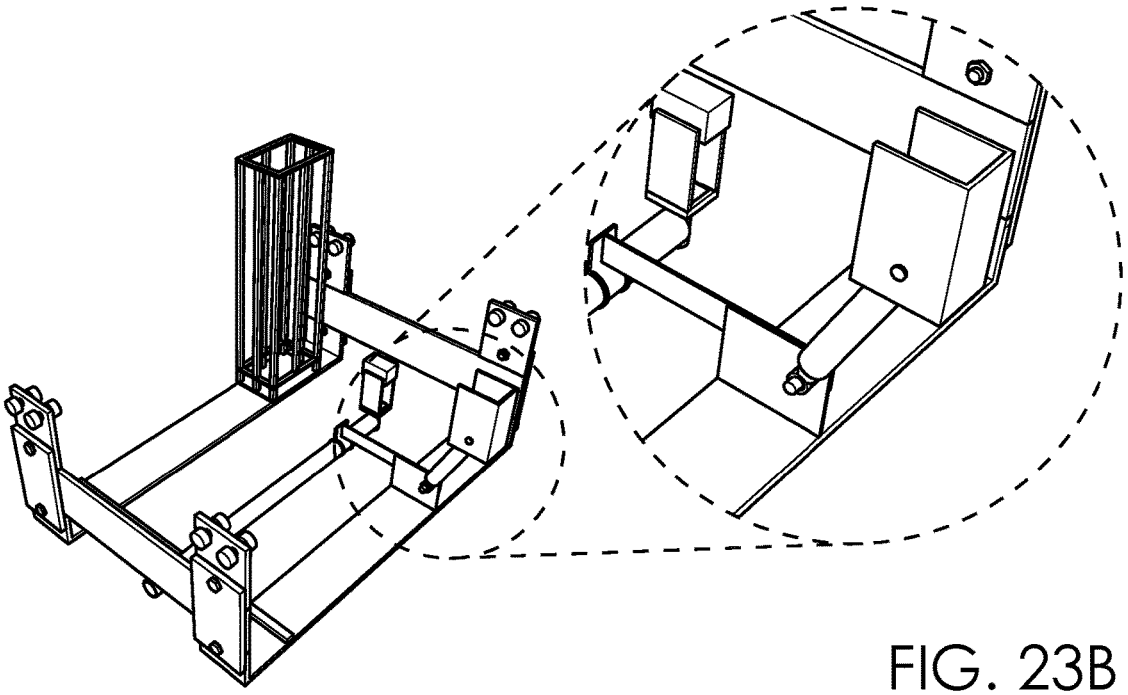

FIGS. 23A and 23B illustrate said sliding assembly actuator 506 in with said sliding assembly 106 in said rearward configuration 600 and said forward configuration 602.

The following sentences comprise a preferred embodiment based on the original patent claims.

Said RPM installer 100 for automatically aligning said RPM dispenser assembly 108 and said adhesive dispenser 110 over said marker location 112 on said roadway 114 and installing said RPM marker 116 at said marker location 112. Said RPM installer 100 comprises said mounting assembly 104, said sliding assembly 106, said RPM dispenser assembly 108 and said adhesive dispenser 110. Said mounting assembly 104 can be configured to attach to said vehicle 202. Said RPM installer 100 comprises said forward movement direction 400 aligned with a forward moving direction of said vehicle 202. Said RPM installer 100 comprises said front side 402 associated with said forward movement direction 400, said rear side 404, said interior side 406 adjacent with said vehicle 202, and said exterior side 408. Said sliding assembly 106 can be configured attach to and selectively slide relative to said mounting assembly 104 in directions substantially aligned with said forward movement direction 400. Said RPM dispenser assembly 108 and said adhesive dispenser 110 can be mounted to a portion of said sliding assembly 106. Said sliding assembly 106 can be configured to selectively slide said sliding assembly 106 between said rearward configuration 600 and said forward configuration 602, each defined relative to said mounting assembly 104 in said forward movement direction 400. With said sliding assembly 106 in said rearward configuration 600, said adhesive dispenser 110 can be aligned over said marker location 112. With said sliding assembly 106 in said forward configuration 602, said RPM dispenser assembly 108 can be aligned over said marker location 112. Said adhesive dispenser 110 comprises said dispensing nozzle 1002 configured to selectively dispense said adhesive fluid 1008. Said RPM installer 100 can be configured for aligning said adhesive dispenser 110 of said marker location 112, dispensing said adhesive fluid 1008 on said marker location 112, aligning said RPM dispenser assembly 108 over said marker location 112, and dispensing said RPM marker 116 on said marker location 112 using said RPM dispenser assembly 108. Said RPM dispenser assembly 108 comprises said RPM stack cage 1100 and said dropper assembly 1104. Said RPM stack cage 1100 can be configured to align and organize one or more of said RPM marker 116 as said RPM stack 1108. Said RPM stack cage 1100 can be configured to encompass a perimeter portion said RPM stack 1108. The lowest said RPM marker 116 of said RPM stack 1108 can be referred to as said bottom RPM 1110. Said RPM stack cage 1100 comprises said dispensing slot 1112 comprising a bottom portion of said RPM stack cage 1100. Said dispensing slot 1112 can be taller than said bottom RPM 1110 and comprises one side being open and configured to allow said bottom RPM 1110 to slide outward and toward said dropper assembly 1104. Thus, said RPM stack 1108 can be configured to allow for said bottom RPM 1110 of said RPM stack 1108 to be selectively dispensed out of said RPM stack cage 1100. Said RPM installer 100 comprises said controller 1802 having said memory 1804, said one or more processors 1806, and said communication hardware 1808. Said memory 1804 host said device application 1810 configured to control operation of said RPM installer 100. Said device application 1810 can be stored in said memory 1804 and executed in said one or more processors 1806. Said RPM dispenser assembly 108 comprises said dropper assembly 1104. Said dropper assembly 1104 comprises said one or more dropper gates 2008. Said dropper assembly 1104 can be configured for: receiving said RPM marker 116 on said one or more dropper gates 2008, transitioning said one or more dropper gates 2008 from a substantially horizontal state to a substantially vertical state, and dropping said RPM marker 116 out of said one or more dropper gates 2008. Said one or more dropper gates 2008 comprise said first dropper gate 2008*a* and said second dropper gate 2008*b*. Each among said one or more dropper gates 2008 comprises said rotating axis 2014, said gate platform 2016, and said counterweight 2018. Said first dropper gate 2008*a* and said second dropper gate 2008*b* face one another and rotate opposite from one another when transitioning from said holding configuration 2000 to said dropping configuration 2002. Said gate platform 2016 of each gate can be substantially aligned with one another when in said holding configuration 2000. Said one or more dropper gates 2008 comprise said gate gap 2020 between said first dropper gate 2008*a* and said second dropper gate 2008*b*. Said gate gap 2020 can be calculated to be smaller than a width of said RPM marker 116. Said gate platform 2016 and said counterweight 2018 can be arranged on opposite sides of said rotating axis 2014. Said counterweight 2018 acts as a damper when said RPM marker 116 can be placed in said one or more dropper gates 2008. Said rotating axis 2014 comprises an axis created by a hinge between a portion of said gate platform 2016 and a fixed portion of said dropper assembly 1104.

Said RPM installer 100 for automatically aligning said RPM dispenser assembly 108 and said adhesive dispenser 110 over said marker location 112 on said roadway 114 and installing said RPM marker 116 at said marker location 112. Said RPM installer 100 comprises said mounting assembly 104, said sliding assembly 106, said RPM dispenser assembly 108 and said adhesive dispenser 110. Said mounting assembly 104 can be configured to attach to said vehicle 202. Said RPM installer 100 comprises said forward movement direction 400 aligned with a forward moving direction of said vehicle 202. Said RPM installer 100 comprises said front side 402 associated with said forward movement direction 400, said rear side 404, said interior side 406 adjacent with said vehicle 202, and said exterior side 408. Said sliding assembly 106 can be configured attach to and selectively slide relative to said mounting assembly 104 in directions substantially aligned with said forward movement direction 400. Said RPM dispenser assembly 108 and said adhesive dispenser 110 can be mounted to a portion of said sliding assembly 106. Said sliding assembly 106 can be configured to selectively slide said sliding assembly 106 between said rearward configuration 600 and said forward configuration 602, each defined relative to said mounting assembly 104 in said forward movement direction 400. With said sliding assembly 106 in said rearward configuration 600, said adhesive dispenser 110 can be aligned over said marker location 112. With said sliding assembly 106 in said forward configuration 602, said RPM dispenser assembly 108 can be aligned over said marker location 112. Said adhesive dispenser 110 comprises said dispensing nozzle 1002 configured to selectively dispense said adhesive fluid 1008. Said RPM installer 100 can be configured for aligning said adhesive dispenser 110 of said marker location 112, dispensing said adhesive fluid 1008 on said marker location 112, aligning said RPM dispenser assembly 108 over said marker location 112, and dispensing said RPM marker 116 on said marker location 112 using said RPM dispenser assembly 108. Said RPM dispenser assembly 108 comprises said RPM stack cage 1100 and said dropper assembly 1104. Said RPM stack cage 1100 can be configured to align and organize one or more of said RPM marker 116 as said RPM stack 1108. Said RPM stack cage 1100 can be configured to encompass a perimeter portion said RPM stack 1108. The lowest said RPM marker 116 of said RPM stack 1108 can be referred to as said bottom RPM 1110. Said RPM stack cage 1100 comprises said dispensing slot 1112 comprising a bottom portion of said RPM stack cage 1100. Said dispensing slot 1112 can be taller than said bottom RPM 1110 and comprises one side being open and configured to allow said bottom RPM 1110 to slide outward and toward said dropper assembly 1104. Thus, said RPM stack 1108 can be configured to allow for said bottom RPM 1110 of said RPM stack 1108 to be selectively dispensed out of said RPM stack cage 1100. Said RPM installer 100 comprises said controller 1802 having said memory 1804, said one or more processors 1806, and said communication hardware 1808. Said memory 1804 host said device application 1810 configured to control operation of said RPM installer 100. Said device application 1810 can be stored in said memory 1804 and executed in said one or more processors 1806. Said RPM dispenser assembly 108 comprises said dropper assembly 1104. Said dropper assembly 1104 comprises said one or more dropper gates 2008. Said dropper assembly 1104 can be configured for: receiving said RPM marker 116 on said one or more dropper gates 2008, transitioning said one or more dropper gates 2008 from a substantially horizontal state to a substantially vertical state, and dropping said RPM marker 116 out of said one or more dropper gates 2008. Said one or more dropper gates 2008 comprise said first dropper gate 2008*a* and said second dropper gate 2008*b*. Each among said one or more dropper gates 2008 comprises said rotating axis 2014, said gate platform 2016, and said counterweight 2018. Said first dropper gate 2008*a* and said second dropper gate 2008*b* face one another and rotate opposite from one another when transitioning from said holding configuration 2000 to said dropping configuration 2002. Said gate platform 2016 of each gate can be substantially aligned with one another when in said holding configuration 2000. Said one or more dropper gates 2008 comprise said gate gap 2020 between said first dropper gate 2008*a* and said second dropper gate 2008*b*. Said gate gap 2020 can be calculated to be smaller than a width of said RPM marker 116. Said gate platform 2016 and said counterweight 2018 can be arranged on opposite sides of said rotating axis 2014. Said counterweight 2018 acts as a damper when said RPM marker 116 can be placed in said one or more dropper gates 2008. Said rotating axis 2014 comprises an axis created by a hinge between a portion of said gate platform 2016 and a fixed portion of said dropper assembly 1104.

Said RPM installer 100 for automatically aligning said RPM dispenser assembly 108 and said adhesive dispenser 110 over said marker location 112 on said roadway 114 and installing said RPM marker 116 at said marker location 112. Said RPM installer 100 comprises said mounting assembly 104, said sliding assembly 106, said RPM dispenser assembly 108 and said adhesive dispenser 110. Said mounting assembly 104 can be configured to attach to said vehicle 202. Said RPM installer 100 comprises said forward movement direction 400 aligned with a forward moving direction of said vehicle 202. Said RPM installer 100 comprises said front side 402 associated with said forward movement direction 400, said rear side 404, said interior side 406 adjacent with said vehicle 202, and said exterior side 408. Said sliding assembly 106 can be configured attach to and selectively slide relative to said mounting assembly 104 in directions substantially aligned with said forward movement direction 400. Said RPM dispenser assembly 108 and said adhesive dispenser 110 can be mounted to a portion of said sliding assembly 106. Said sliding assembly 106 can be configured to selectively slide said sliding assembly 106 between said rearward configuration 600 and said forward configuration 602, each defined relative to said mounting assembly 104 in said forward movement direction 400. With said sliding assembly 106 in said rearward configuration 600, said adhesive dispenser 110 can be aligned over said marker location 112. With said sliding assembly 106 in said forward configuration 602, said RPM dispenser assembly 108 can be aligned over said marker location 112. Said adhesive dispenser 110 comprises said dispensing nozzle 1002 configured to selectively dispense said adhesive fluid 1008. Said RPM installer 100 can be configured for aligning said adhesive dispenser 110 of said marker location 112, dispensing said adhesive fluid 1008 on said marker location 112, aligning said RPM dispenser assembly 108 over said marker location 112, and dispensing said RPM marker 116 on said marker location 112 using said RPM dispenser assembly 108.

Said RPM installer 100 can be configured to mount to said trailer 102 to be pulled by said vehicle 202.

Said mounting assembly 104 comprises said mounting frame 410 comprising said one or more horizontal portions 412 and said one or more longitudinal portions 414. Said one or more horizontal portions 412 and said one or more longitudinal portions 414 can be attached to one another at perpendicular angles. Said one or more longitudinal portions 414 can be aligned with said forward movement direction 400. Said one or more longitudinal portions 414 comprises said first longitudinal portion 414*a* and said second longitudinal portion 414*b*. Said one or more horizontal portions 412 comprises said first horizontal portion 412*a* and said second horizontal portion 412*b*. Said sliding assembly 106 slidably attach to a portion of said one or more longitudinal portions 414.

Said sliding assembly 106 comprises said sliding assembly actuator 506. Said one or more longitudinal portions 414 comprises said longitudinal slot 500. Said sliding assembly 106 comprises said one or more sliding hangers 502 configured to selectively slide within said longitudinal slot 500 of said one or more longitudinal portions 414. Said sliding assembly 106 comprises a support frame comprising said one or more sliding hangers 502 connected to said one or more horizontal supports 504. Said RPM installer 100 comprises said sliding assembly actuator 506 attached at its ends between said mounting assembly 104 and said sliding assembly 106. Each among said one or more sliding hangers 502 comprises said wheel assembly 800 configured to slide within said longitudinal slot 500 of said one or more longitudinal portions 414 aligned with said forward movement direction 400. Said sliding assembly 106 hang down from said mounting assembly 104 and slide within said one or more longitudinal portions 414.

Said one or more longitudinal portions 414 comprises square tubing box channel.

Said RPM dispenser assembly 108 comprises said RPM stack cage 1100 and said dropper assembly 1104. Said RPM stack cage 1100 can be configured to align and organize one or more of said RPM marker 116 as said RPM stack 1108. Said RPM stack cage 1100 can be configured to encompass a perimeter portion said RPM stack 1108. The lowest said RPM marker 116 of said RPM stack 1108 can be referred to as said bottom RPM 1110. Said RPM stack cage 1100 comprises said dispensing slot 1112 comprising a bottom portion of said RPM stack cage 1100. Said dispensing slot 1112 can be taller than said bottom RPM 1110 and comprises one side being open and configured to allow said bottom RPM 1110 to slide outward and toward said dropper assembly 1104. Thus, said RPM stack 1108 can be configured to allow for said bottom RPM 1110 of said RPM stack 1108 to be selectively dispensed out of said RPM stack cage 1100.

Said RPM dispenser assembly 108 further comprises said pusher assembly 1102. Said pusher assembly 1102 can be configured to push said bottom RPM 1110 through an open portion of said dispensing slot 1112 and into said dropper assembly 1104. Said pusher assembly 1102 comprises said pusher body 1202 and said pusher actuator 1204. Said pusher actuator 1204 can be activated and deactivated to adjust a condition of said pusher assembly 1102.

Said pusher body 1202 of said pusher assembly 1102 comprises said distal pushing face 1900 and said RPM marker 116 comprises said first side 1902. With said pusher assembly 1102 and said RPM marker 116 in said dropper assembly 1104, said distal pushing face 1900 and said first side 1902 can be substantially aligned and said distal pushing face 1900 and said first side 1902 can be substantially aligned in a plane.

Said RPM installer 100 comprises said controller 1802 having said memory 1804, said one or more processors 1806, and said communication hardware 1808. Said memory 1804 host said device application 1810 configured to control operation of said RPM installer 100. Said device application 1810 can be stored in said memory 1804 and executed in said one or more processors 1806.

Said RPM installer 100 further comprise said control manifold 1816 and said compressor 1818. Said compressor 1818 provides compressed air to said control manifold 1816. Said control manifold 1816 selectively directs said compressed air to said one or more actuators according to instructions received from said device application 1810 to control portions of said RPM installer 100.

Said RPM installer 100 further comprise said one or more sensors 1814. Said one or more sensors 1814 monitor performance of said RPM installer 100 and ensure said adhesive fluid 1008 and said RPM marker 116 can be installed correctly and at said marker location 112.

Said RPM dispenser assembly 108 comprises said dropper assembly 1104. Said dropper assembly 1104 comprises said one or more dropper gates 2008. Said dropper assembly 1104 can be configured for: receiving said RPM marker 116 on said one or more dropper gates 2008, transitioning said one or more dropper gates 2008 from a substantially horizontal state to a substantially vertical state, and dropping said RPM marker 116 out of said one or more dropper gates 2008.

Said dropper assembly 1104 further comprises said dropper actuator 2004, said first end mounting bracket 2006, and said actuator-trigger transfer assembly 2010. Said first end mounting bracket 2006 attaches one end of said dropper actuator 2004 to a portion of said RPM installer 100. Said dropper assembly 1104 can be configured for: receiving said RPM marker 116 on said one or more dropper gates 2008, activating said dropper actuator 2004 to extend and press a portion of said actuator-trigger transfer assembly 2010, pressing a portion of said actuator-trigger transfer assembly 2010 causes said one or more dropper gates 2008 to transition from a substantially horizontal state to a substantially vertical state, and dropping said RPM marker 116 out of said one or more dropper gates 2008.

Said actuator-trigger transfer assembly 2010 comprises said rotary element 2012 configured to pull a portion of said one or more dropper gates 2008 when said dropper actuator 2004 can be pressing on another portion of said rotary element 2012. Each among said one or more dropper gates 2008 comprises said rotating axis 2014, said gate platform 2016, and said counterweight 2018. Said gate platform 2016 and said counterweight 2018 can be arranged on opposite sides of said rotating axis 2014. Said counterweight 2018 acts as a damper when said RPM marker 116 can be placed in said one or more dropper gates 2008. Said rotating axis 2014 comprises an axis created by a hinge between a portion of said gate platform 2016 and a fixed portion of said dropper assembly 1104.

Said one or more dropper gates 2008 comprise said first dropper gate 2008*a* and said second dropper gate 2008*b*. Each among said one or more dropper gates 2008 comprises said rotating axis 2014, said gate platform 2016, and said counterweight 2018. Said first dropper gate 2008*a* and said second dropper gate 2008*b* face one another and rotate opposite from one another when transitioning from said holding configuration 2000 to said dropping configuration 2002. Said gate platform 2016 of each gate can be substantially aligned with one another when in said holding configuration 2000. Said one or more dropper gates 2008 comprise said gate gap 2020 between said first dropper gate 2008*a* and said second dropper gate 2008*b*. Said gate gap 2020 can be calculated to be smaller than a width of said RPM marker 116. Said gate platform 2016 and said counterweight 2018 can be arranged on opposite sides of said rotating axis 2014. Said counterweight 2018 acts as a damper when said RPM marker 116 can be placed in said one or more dropper gates 2008. Said rotating axis 2014 comprises an axis created by a hinge between a portion of said gate platform 2016 and a fixed portion of said dropper assembly 1104.

Said masher assembly 1106 comprises said mashing extension 2204, said masher actuator 2206, and said spring head 2208. Said masher actuator 2206 can be configured to extend and contract said mashing extension 2204. Said masher assembly 1106 comprises said retracted configuration 2200 and said mashing configuration 2202. Said mashing configuration 2202 comprises said mashing extension 2204 extended down toward said marker location 112 and pressing said RPM marker 116 to secure the same to said roadway 114 and said adhesive fluid 1008. Said retracted configuration 2200 comprises said mashing extension 2204 pulled out of the way of said dropper assembly 1104. Said spring head 2208 can be configured to soften a pressing action when applied to said RPM marker 116 to prevent damage to parts of said RPM installer 100.

Said gate gap 2020 can be wide enough to allow said masher actuator 2206 to pass through said dropper assembly 1104 without getting caught on said gate platform 2016 regardless the configuration of said dropper assembly 1104. Said one or more dropper gates 2008 comprise said first dropper gate 2008*a* and said second dropper gate 2008*b*. Said first dropper gate 2008*a* and said second dropper gate 2008*b* face one another and rotate opposite from one another when transitioning from said holding configuration 2000 to said dropping configuration 2002. Said one or more dropper gates 2008 comprise said gate gap 2020 between said first dropper gate 2008*a* and said second dropper gate 2008*b*.

Said RPM installer 100 for automatically aligning said RPM dispenser assembly 108 and said adhesive dispenser 110 over said marker location 112 on said roadway 114 and installing said RPM marker 116 at said marker location 112. Said RPM installer 100 comprises said mounting assembly 104, said sliding assembly 106, said RPM dispenser assembly 108 and said adhesive dispenser 110. Said mounting assembly 104 can be configured to attach to said vehicle 202. Said RPM installer 100 comprises said forward movement direction 400 aligned with a forward moving direction of said vehicle 202. Said RPM installer 100 comprises said front side 402 associated with said forward movement direction 400, said rear side 404, said interior side 406 adjacent with said vehicle 202, and said exterior side 408. Said adhesive dispenser 110 comprises said dispensing nozzle 1002 configured to selectively dispense said adhesive fluid 1008. Said RPM installer 100 can be configured for aligning said adhesive dispenser 110 of said marker location 112, dispensing said adhesive fluid 1008 on said marker location 112, aligning said RPM dispenser assembly 108 over said marker location 112, and dispensing said RPM marker 116 on said marker location 112 using said RPM dispenser assembly 108. Said RPM dispenser assembly 108 comprises said dropper assembly 1104. Said dropper assembly 1104 comprises said one or more dropper gates 2008. Said dropper assembly 1104 can be configured for: receiving said RPM marker 116 on said one or more dropper gates 2008, transitioning said one or more dropper gates 2008 from a substantially horizontal state to a substantially vertical state, and dropping said RPM marker 116 out of said one or more dropper gates 2008. Said one or more dropper gates 2008 comprise said first dropper gate 2008*a* and said second dropper gate 2008*b*. Each among said one or more dropper gates 2008 comprises said rotating axis 2014, said gate platform 2016, and said counterweight 2018. Said first dropper gate 2008*a* and said second dropper gate 2008*b* face one another and rotate opposite from one another when transitioning from said holding configuration 2000 to said dropping configuration 2002. Said gate platform 2016 of each gate can be substantially aligned with one another when in said holding configuration 2000. Said one or more dropper gates 2008 comprise said gate gap 2020 between said first dropper gate 2008*a* and said second dropper gate 2008*b*. Said gate gap 2020 can be calculated to be smaller than a width of said RPM marker 116. Said gate platform 2016 and said counterweight 2018 can be arranged on opposite sides of said rotating axis 2014. Said counterweight 2018 acts as a damper when said RPM marker 116 can be placed in said one or more dropper gates 2008. Said rotating axis 2014 comprises an axis created by a hinge between a portion of said gate platform 2016 and a fixed portion of said dropper assembly 1104.

The following listing of the parts is included for the convenience of the reader.

Said RPM installer 100,
said trailer 102,
said mounting assembly 104,
said sliding assembly 106,
said RPM dispenser assembly 108,
said adhesive dispenser 110,
said marker location 112,
said roadway 114,
said RPM marker 116,
said marker spacing 200,
said vehicle 202,
said flatbed truck 300,
said forward movement direction 400,
said front side 402,
said rear side 404,
said interior side 406,
said exterior side 408,
said mounting frame 410,
said one or more horizontal portions 412,
said one or more longitudinal portions 414,
said first longitudinal portion 414*a*,
said second longitudinal portion 414*b*,
said first horizontal portion 412*a*,
said second horizontal portion 412*b*,
said longitudinal slot 500,
said one or more sliding hangers 502,
said one or more horizontal supports 504,
said sliding assembly actuator 506,
said rearward configuration 600,
said forward configuration 602,
said wheel assembly 800,
said fluid input 1000,
said dispensing nozzle 1002,
said proximate end 1004,
said distal end 1006,
said adhesive fluid 1008,
said RPM stack cage 1100,
said pusher assembly 1102, said dropper assembly 1104,
said masher assembly 1106,
said RPM stack 1108,
said bottom RPM 1110,
said dispensing slot 1112,
said ready configuration 1200,
said pusher body 1202,
said pusher actuator 1204,
said loaded configuration 1300,
said dropped configuration 1400,
said engaged configuration 1500,
said reset configuration 1700,
said block diagram 1800,
said controller 1802,
said memory 1804,
said one or more processors 1806,
said communication hardware 1808,
said device application 1810,
said remote 1812,
said one or more sensors 1814,
said control manifold 1816,
said compressor 1818,
said adhesive reservoir 1820,
said distal pushing face 1900,
said first side 1902,
said holding configuration 2000,
said dropping configuration 2002,
said dropper actuator 2004,
said first end mounting bracket 2006,
said one or more dropper gates 2008,
said actuator-trigger transfer assembly 2010,
said first dropper gate 2008*a*,
said second dropper gate 2008*b*,
said rotary element 2012,
said rotating axis 2014,
said gate platform 2016,
said counterweight 2018,
said gate gap 2020,
said retracted configuration 2200,
said mashing configuration 2202,
said mashing extension 2204,
said masher actuator 2206, and
said spring head 2208.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An RPM installer for automatically aligning an RPM dispenser assembly and an adhesive dispenser over a marker location on a roadway and installing an RPM marker at said marker location, wherein:

said RPM installer comprises a mounting assembly, a sliding assembly, said RPM dispenser assembly and said adhesive dispenser;

said mounting assembly is configured to attach to a vehicle;

said RPM installer comprises a forward movement direction aligned with a forward moving direction of said vehicle;

said RPM installer comprises a front side associated with said forward movement direction, a rear side, an interior side adjacent with said vehicle, and an exterior side;

said sliding assembly is configured to attach to and selectively slide relative to said mounting assembly in directions substantially aligned with said forward movement direction;

said RPM dispenser assembly and said adhesive dispenser are mounted to a portion of said sliding assembly;

said sliding assembly is configured to selectively slide between a rearward configuration and a forward configuration, each defined relative to said mounting assembly in said forward movement direction;

with said sliding assembly in said rearward configuration, said adhesive dispenser is aligned over said marker location;

with said sliding assembly in said forward configuration, said RPM dispenser assembly is aligned over said marker location;

said adhesive dispenser comprises a dispensing nozzle configured to selectively dispense an adhesive fluid;

said RPM installer is configured for:

aligning said adhesive dispenser with said marker location, dispensing said adhesive fluid on said marker location, aligning said RPM dispenser assembly with said marker location, and dispensing said RPM marker on said marker location using said RPM dispenser assembly;

said RPM dispenser assembly comprises an RPM stack cage and a dropper assembly;

said RPM stack cage is configured to align and organize one or more of said RPM markers as an RPM stack;

said RPM stack cage is configured to encompass a perimeter portion said RPM stack;

the lowest said RPM marker of said RPM stack is referred to as a bottom RPM;

said RPM stack cage comprises a dispensing slot comprising a bottom portion of said RPM stack cage;

said dispensing slot is taller than said bottom RPM and comprises one side being open and configured to allow said bottom RPM to slide outward and toward said dropper assembly;

thus, said RPM stack is configured to allow for said bottom RPM of said RPM stack to be selectively dispensed out of said RPM stack cage;

said RPM installer comprises a controller having a memory, one or more processors, and a communication hardware;

said memory host a device application configured to control operation of said RPM installer;

said device application is stored in said memory and executed in said one or more processors;

said RPM dispenser assembly comprises said dropper assembly;

said dropper assembly comprises one or more dropper gates;

said dropper assembly is configured for:

receiving said RPM marker on said one or more dropper gates, transitioning said one or more dropper gates from a substantially horizontal state to a substantially vertical state, and dropping said RPM marker out of said one or more dropper gates;

said one or more dropper gates comprise a first dropper gate and a second dropper gate;

each among said one or more dropper gates comprises a rotating axis, a gate platform, and a counterweight;

said first dropper gate and said second dropper gate face one another and rotate opposite from one another when transitioning from a holding configuration to a dropping configuration;

said gate platform of each gate are substantially aligned with one another when in said holding configuration;

said one or more dropper gates comprise a gate gap between said first dropper gate and said second dropper gate;

said gate gap is calculated to be smaller than a width of said RPM marker;

said gate platform and said counterweight is arranged on opposite sides of said rotating axis;

said counterweight acts as a damper when said RPM marker is placed in said one or more dropper gates; and said rotating axis comprises an axis created by a hinge between a portion of said gate platform and a fixed portion of said dropper assembly.

2. An RPM installer for automatically aligning an RPM dispenser assembly and an adhesive dispenser over a marker location on a roadway and installing an RPM marker at said marker location, wherein:

said RPM installer comprises a mounting assembly, a sliding assembly, said RPM dispenser assembly and said adhesive dispenser;

said mounting assembly is configured to attach to a vehicle;

said RPM installer comprises a forward movement direction aligned with a forward moving direction of said vehicle;

said RPM installer comprises a front side associated with said forward movement direction, a rear side, an interior side adjacent with said vehicle, and an exterior side;

said sliding assembly is configured to attach to and selectively slide relative to said mounting assembly in directions substantially aligned with said forward movement direction;

said RPM dispenser assembly and said adhesive dispenser are mounted to a portion of said sliding assembly;

said sliding assembly is configured to selectively slide between a rearward configuration and a forward configuration, each defined relative to said mounting assembly in said forward movement direction;

with said sliding assembly in said rearward configuration, said adhesive dispenser is aligned over said marker location;

with said sliding assembly in said forward configuration, said RPM dispenser assembly is aligned over said marker location;

said adhesive dispenser comprises a dispensing nozzle configured to selectively dispense an adhesive fluid; and said RPM installer is configured for:

aligning said adhesive dispenser over said marker location, dispensing said adhesive fluid on said marker location, aligning said RPM dispenser assembly over said marker location, and dispensing said RPM marker on said marker location using said RPM dispenser assembly.

3. The RPM installer of claim 2, wherein:

said RPM installer is configured to mount to A trailer to be pulled by said vehicle.

4. The RPM installer of claim 2, wherein:

said mounting assembly comprises a mounting frame comprising one or more horizontal portions and one or more longitudinal portions;

said one or more horizontal portions and said one or more longitudinal portions is attached to one another at perpendicular angles;

said one or more longitudinal portions is aligned with said forward movement direction;

said one or more longitudinal portions comprises a first longitudinal portion and a second longitudinal portion;

said one or more horizontal portions comprises a first horizontal portion and a second horizontal portion; and said sliding assembly slidably attach to a portion of said one or more longitudinal portions.

5. The RPM installer of claim 4, wherein:

said sliding assembly comprises A sliding assembly actuator;

said one or more longitudinal portions comprises a longitudinal slot;

said sliding assembly comprises one or more sliding hangers configured to selectively slide within said longitudinal slot of said one or more longitudinal portions;

said sliding assembly comprises a support frame comprising said one or more sliding hangers connected to one or more horizontal supports;

said RPM installer comprises said sliding assembly actuator attached at its ends between said mounting assembly and said sliding assembly;

each among said one or more sliding hangers comprises a wheel assembly configured to slide within said longitudinal slot of said one or more longitudinal portions aligned with said forward movement direction; and said sliding assembly hang down from said mounting assembly and slide within said one or more longitudinal portions.

6. The RPM installer of claim 5, wherein:

said one or more longitudinal portions comprises square tubing box channel.

7. The RPM installer of claim 2, wherein:

said RPM dispenser assembly comprises an RPM stack cage and a dropper assembly;

said RPM stack cage is configured to align and organize one or more of said RPM marker as an RPM stack;

said RPM stack cage is configured to encompass a perimeter portion said RPM stack;

the lowest said RPM marker of said RPM stack is referred to as a bottom RPM;

said RPM stack cage comprises a dispensing slot comprising a bottom portion of said RPM stack cage;

said dispensing slot is taller than said bottom RPM and comprises one side being open and configured to allow said bottom RPM to slide outward and toward said dropper assembly; and thus, said RPM stack is configured to allow for said bottom RPM of said RPM stack to be selectively dispensed out of said RPM stack cage.

8. The RPM installer of claim 7, wherein:

said RPM dispenser assembly further comprises A pusher assembly;

said pusher assembly is configured to push said bottom RPM through an open portion of said dispensing slot and into said dropper assembly;

said pusher assembly comprises a pusher body and a pusher actuator; and said pusher actuator is activated and deactivated to adjust a condition of said pusher assembly.

9. The RPM installer of claim 8, wherein:

said pusher body of said pusher assembly comprises A distal pushing face and said RPM marker comprises a first side; and with said pusher assembly and said RPM marker in said dropper assembly, said distal pushing face and said first side are substantially aligned and said distal pushing face and said first side are substantially aligned in a plane.

10. The RPM installer of claim 2, wherein:

said RPM installer comprises A controller having a memory, one or more processors, and a communication hardware;

said memory host a device application configured to control operation of said RPM installer; and said device application is stored in said memory and executed in said one or more processors.

11. The RPM installer of claim 10, wherein:

said RPM installer further comprise A control manifold and a compressor;

said compressor provides compressed air to said control manifold; and said control manifold selectively directs said compressed air to said one or more actuators according to instructions received from said device application to control portions of said RPM installer.

12. The RPM installer of claim 10, wherein:

said RPM installer further comprise One or more sensors; and said one or more sensors monitor performance of said RPM installer and ensure said adhesive fluid and said RPM marker are installed correctly and at said marker location.

13. The RPM installer of claim 2, wherein:

said RPM dispenser assembly comprises said dropper assembly;

said dropper assembly comprises one or more dropper gates; and said dropper assembly is configured for:

receiving said RPM marker on said one or more dropper gates, transitioning said one or more dropper gates from a substantially horizontal state to a substantially vertical state, and dropping said RPM marker out of said one or more dropper gates.

14. The RPM installer of claim 13, wherein:

said dropper assembly further comprises A dropper actuator, a first end mounting bracket, and an actuator-trigger transfer assembly;

said first end mounting bracket attaches one end of said dropper actuator to a portion of said RPM installer; and said dropper assembly is configured for:

receiving said RPM marker on said one or more dropper gates, activating said dropper actuator to extend and press a portion of said actuator-trigger transfer assembly, pressing a portion of said actuator-trigger transfer assembly causes said one or more dropper gates to transition from a substantially horizontal state to a substantially vertical state, and dropping said RPM marker out of said one or more dropper gates.

15. The RPM installer of claim 14, wherein:

said actuator-trigger transfer assembly comprises A rotary element configured to pull a portion of said one or more dropper gates when said dropper actuator is pressing on another portion of said rotary element;

each among said one or more dropper gates comprises a rotating axis, a gate platform, and a counterweight;

said gate platform and said counterweight is arranged on opposite sides of said rotating axis;

said counterweight acts as a damper when said RPM marker is placed in said one or more dropper gates; and said rotating axis comprises an axis created by a hinge between a portion of said gate platform and a fixed portion of said dropper assembly.

16. The RPM installer of claim 13, wherein:

said one or more dropper gates comprise A first dropper gate and a second dropper gate;

each among said one or more dropper gates comprises said rotating axis, said gate platform, and said counterweight;

said first dropper gate and said second dropper gate face one another and rotate opposite from one another when transitioning from a holding configuration to a dropping configuration;

said gate platform of each gate are substantially aligned with one another when in said holding configuration;

said one or more dropper gates comprise a gate gap between said first dropper gate and said second dropper gate;

said gate gap is calculated to be smaller than a width of said RPM marker;

said gate platform and said counterweight is arranged on opposite sides of said rotating axis;

said counterweight acts as a damper when said RPM marker is placed in said one or more dropper gates; and said rotating axis comprises an axis created by a hinge between a portion of said gate platform and a fixed portion of said dropper assembly.

17. The RPM installer of claim 2, wherein:

A masher assembly comprises a mashing extension, a masher actuator, and a spring head;

said masher actuator is configured to extend and contract said mashing extension;

said masher assembly comprises a retracted configuration and a mashing configuration;

said mashing configuration comprises said mashing extension extended down toward said marker location and pressing said RPM marker to secure the same to said roadway and said adhesive fluid;

said retracted configuration comprises said mashing extension pulled out of the way of said dropper assembly; and said spring head is configured to soften a pressing action when applied to said RPM marker to prevent damage to parts of said RPM installer.

18. The RPM installer of claim 17, wherein:

said gate gap is wide enough to allow said masher actuator to pass through said dropper assembly without getting caught on said gate platform regardless the configuration of said dropper assembly;

said one or more dropper gates comprise said first dropper gate and said second dropper gate;

said first dropper gate and said second dropper gate face one another and rotate opposite from one another when transitioning from said holding configuration to said dropping configuration; and said one or more dropper gates comprise said gate gap between said first dropper gate and said second dropper gate.

19. An RPM installer for automatically aligning an RPM dispenser assembly and an adhesive dispenser over a marker location on a roadway and installing an RPM marker at said marker location, wherein:

said RPM installer comprises a mounting assembly, a sliding assembly, said RPM dispenser assembly and said adhesive dispenser;

said mounting assembly is configured to attach to a vehicle;

said RPM installer comprises a forward movement direction aligned with a forward moving direction of said vehicle;

said RPM installer comprises a front side associated with said forward movement direction, a rear side, an interior side adjacent with said vehicle, and an exterior side;

said adhesive dispenser comprises a dispensing nozzle configured to selectively dispense an adhesive fluid;

said RPM installer is configured for aligning said adhesive dispenser over said marker location, dispensing said adhesive fluid on said marker location, aligning said RPM dispenser assembly over said marker location, and dispensing said RPM marker on said marker location using said RPM dispenser assembly;

said RPM dispenser assembly comprises a dropper assembly;

said dropper assembly comprises one or more dropper gates;

said dropper assembly is configured for:

receiving said RPM marker on said one or more dropper gates, transitioning said one or more dropper gates from a substantially horizontal state to a substantially vertical state, and dropping said RPM marker out of said one or more dropper gates;

said one or more dropper gates comprise a first dropper gate and a second dropper gate;

each among said one or more dropper gates comprises a rotating axis, a gate platform, and a counterweight;

said first dropper gate and said second dropper gate face one another and rotate opposite from one another when transitioning from a holding configuration to a dropping configuration;

said gate platform of each gate are substantially aligned with one another when in said holding configuration;

said one or more dropper gates comprise a gate gap between said first dropper gate and said second dropper gate;

said gate gap is calculated to be smaller than a width of said RPM marker;

said gate platform and said counterweight is arranged on opposite sides of said rotating axis;

said counterweight acts as a damper when said RPM marker is placed in said one or more dropper gates; and said rotating axis comprises an axis created by a hinge between a portion of said gate platform and a fixed portion of said dropper assembly.

20. The RPM installer of claim 19, wherein:

said RPM dispenser assembly comprises An RPM stack cage and said dropper assembly;

said RPM stack cage is configured to align and organize one or more of said RPM marker as an RPM stack;

said RPM stack cage is configured to encompass a perimeter portion said RPM stack;

the lowest said RPM marker of said RPM stack is referred to as a bottom RPM;

said RPM stack cage comprises a dispensing slot comprising a bottom portion of said RPM stack cage;

said dispensing slot is taller than said bottom RPM and comprises one side being open and configured to allow said bottom RPM to slide outward and toward said dropper assembly;

thus, said RPM stack is configured to allow for said bottom RPM of said RPM stack to be selectively dispensed out of said RPM stack cage;

said RPM dispenser assembly further comprises a pusher assembly;

said pusher assembly is configured to push said bottom RPM through an open portion of said dispensing slot and into said dropper assembly;

said pusher assembly comprises a pusher body and a pusher actuator;

said pusher actuator is activated and deactivated to adjust a condition of said pusher assembly;

said pusher body of said pusher assembly comprises a distal pushing face and said RPM marker comprises a first side; and with said pusher assembly and said RPM marker in said dropper assembly, said distal pushing face and said first side are substantially aligned and said distal pushing face and said first side are substantially aligned in a plane.

* * * * *